US012097995B2

(12) United States Patent
Wolff et al.

(10) Patent No.: US 12,097,995 B2
(45) Date of Patent: Sep. 24, 2024

(54) CUSTOMIZABLE CADDY FOR TILT BINS

(71) Applicant: Deflecto, LLC, Indianapolis, IN (US)

(72) Inventors: Rob Wolff, Indianapolis, IN (US); Craig R. Malmloff, Indianapolis, IN (US); Matt Dawson, Indianapolis, IN (US)

(73) Assignee: Deflecto, LLC, Indianapolis, IN (US)

( * ) Notice: Subject to any disclaimer, the term of this patent is extended or adjusted under 35 U.S.C. 154(b) by 69 days.

(21) Appl. No.: 18/070,981

(22) Filed: Nov. 29, 2022

(65) Prior Publication Data

US 2024/0174406 A1 May 30, 2024

(51) Int. Cl.
*B65D 25/04* (2006.01)
*B65D 25/28* (2006.01)

(52) U.S. Cl.
CPC ..... *B65D 25/04* (2013.01); *B65D 25/2823* (2013.01)

(58) Field of Classification Search
CPC ..... B65D 25/04; B65D 25/2823
USPC ..... 206/509
See application file for complete search history.

(56) References Cited

U.S. PATENT DOCUMENTS 532,324 A 1/1895 Kolb
3,150,902 A * 9/1964 Naab ..... A61B 50/10 312/289
3,333,730 A 8/1967 Zarlinski
4,109,926 A 8/1978 Lane
4,364,150 A 12/1982 Remington
3,349,958 A 10/1984 Breneman
4,505,506 A 3/1985 Picozza
4,714,158 A 12/1987 Oltman et al.
5,415,277 A 5/1995 Berntsen
5,423,445 A 6/1995 Montanari et al.
5,609,282 A 3/1997 Melanson
5,904,388 A 5/1999 Seibel
6,059,109 A 5/2000 Stein
6,062,385 A * 5/2000 Cho ..... A45C 3/02 220/819
6,607,199 B2 8/2003 Gruber
7,559,514 B1 7/2009 Wynter
8,636,169 B2 1/2014 Sampaio
D789,088 S * 6/2017 Stuart ..... D3/297
9,969,526 B1 5/2018 Lowther et al.
(Continued)

FOREIGN PATENT DOCUMENTS

DE 3702061 A1 8/1987
TW M397307 2/2011
WO 2022165191 8/2022

OTHER PUBLICATIONS

Extended European Search Report, European Application No. 23212781.1-1017, dated May 2, 2024, 7 pages.

*Primary Examiner* — Nathan J Jenness
*Assistant Examiner* — Eric C Baldrighi
(74) *Attorney, Agent, or Firm* — Barnes & Thornburg LLP

(57) ABSTRACT

A customizable storage system includes at least one removable storage container and a container caddy. The at least one removeable storage container includes a container shell and a tilt bin located in the container shell and configured to tilt relative to the container shell. The container caddy includes a container support frame having first and second container docks that each define first and second container-receiving spaces the receive the at least one storage container and a carrying handle coupled to and extending away from the container support frame.

20 Claims, 32 Drawing Sheets

(56) References Cited

U.S. PATENT DOCUMENTS

| | | | | |
|---|---|---|---|---|
| 10,308,409 | B2 | 6/2019 | Stuart et al. | |
| 10,343,702 | B2 | 7/2019 | Stuart et al. | |
| 10,967,499 | B2 | 4/2021 | Yogev et al. | |
| 11,059,504 | B2 | 7/2021 | Stuart et al. | |
| 2002/0030425 | A1 | 3/2002 | Tiramani et al. | |
| 2002/0040880 | A1 | 4/2002 | Vasudeva | |
| 2002/0179462 | A1 | 12/2002 | Silvers | |
| 2003/0015445 | A1* | 1/2003 | Levy | B25H 3/023 206/373 |
| 2005/0247588 | A1 | 11/2005 | Hedges | |
| 2006/0144732 | A1 | 7/2006 | Kaplan et al. | |
| 2006/0157373 | A1 | 7/2006 | Griffith | |
| 2006/0272556 | A1 | 12/2006 | Apps | |
| 2008/0000899 | A1 | 1/2008 | Baker et al. | |
| 2009/0255092 | A1 | 10/2009 | Huang et al. | |
| 2009/0256454 | A1* | 10/2009 | Landau | B25H 3/028 312/249.11 |
| 2010/0176022 | A1 | 7/2010 | Furlong | |
| 2011/0005433 | A1 | 1/2011 | Pichereau | |
| 2011/0061572 | A1 | 3/2011 | Liu et al. | |
| 2011/0080077 | A1 | 4/2011 | Lin | |
| 2012/0326406 | A1* | 12/2012 | Lifshitz | B25H 3/02 206/503 |
| 2013/0021787 | A1 | 1/2013 | Noble | |
| 2013/0056378 | A1 | 3/2013 | Su | |
| 2014/0311926 | A1 | 10/2014 | Walters et al. | |
| 2014/0319302 | A1 | 10/2014 | Baltz | |
| 2015/0021322 | A1 | 1/2015 | Rosenblum | |
| 2015/0210426 | A1 | 7/2015 | Funaki | |
| 2016/0130034 | A1 | 5/2016 | Kuhls et al. | |
| 2016/0264292 | A1 | 9/2016 | Schoening | |
| 2017/0190465 | A1 | 7/2017 | Nussbaum et al. | |
| 2019/0152043 | A1 | 5/2019 | Shechtman et al. | |

* cited by examiner

CUSTOMIZABLE CADDY FOR TILT BINS

FIELD OF DISCLOSURE

The present disclosure relates to a container system that includes a portable carrying base configured to receive interchangeable storage receptacles. One or more individual container systems can be combined to create a larger organizational unit.

BACKGROUND

Storing items such as office or craft supply items can be difficult with current storage systems. This is because known storage solutions do not offer the flexibility to interchange storage receptacles or easily stack and carry more than one storage solution.

SUMMARY

The present disclosure includes one, or more of the features recited in the appended claims and/or the following features which, alone or in any combination, may comprise patentable subject matter.

A customizable storage system may comprise a storage unit. The storage unit may comprise at least one removable storage container, a container caddy, and at least one container rotary lock.

In some embodiments, the at least one removeable storage container may include a container shell and a tilt bin. The tilt bin may be located in the container shell. The tilt bin may be formed to include an aperture arranged to open into a storage space formed in the tilt bin. The tilt bin may be configured to tilt relative to the container shell between a retracted storage position in which the container shell blocks access to the storage space of the tilt bin through the aperture and an extended use position in which the tilt bin has tilted away from the container shell to allow access to the storage space through the aperture.

In some embodiments, the container caddy may include a container support frame. The container support frame may have a first container dock, a second container dock, a handle foundation, and a carrying handle. The first container dock may define a first container-receiving space configured to receive the at least one removable storage container. The second container dock may be spaced apart from the first container dock. The second container dock may define a second container-receiving space configured to receive the at least one removable storage container. The handle foundation may extend between and interconnect the first container dock and the second container dock. The carrying handle may be coupled to and extend away from the handle foundation of the container support frame.

In some embodiments, the at least one container rotary lock may be configured to rotate between an unlocked position and a locked position. In the unlocked position, the tilt bin of the at least one removable storage container may be free to change between the retracted storage position and the extended use position. In locked position, the tilt bin may be blocked from tilting relative to the container shell from the retracted storage position to the extended use position to prevent unwanted access to the storage space of the tilt bin through the aperture. In the locked position, the at least one removable storage container may be blocked from moving relative to the container caddy from a stored position on the container caddy to prevent unwanted removal of the at least one removable storage container from one of the first container-receiving space formed in the first container dock and the second container-receiving space formed in the second container dock.

In some embodiments, the at least one container rotary lock may include a lock rod, a lock knob, and a lock arm. The lock rod may have a first end and a second end. The first end may be coupled to a first side of the container support frame. The second end may be spaced apart axially from the first end of the lock rod along an axis. The second end may be coupled to a second side of the container support frame. The lock knob may be coupled to one of the first end and the second end of the lock rod for rotation therewith. The lock arm may extend radially from the lock rod relative to the axis. The lock arm may be configured to engage the tilt bin when the at least one container rotary lock is in the locked position.

In some embodiments, the customizable storage system may further comprise a container drop-in lock. The container drop-in lock may be configured to retain the at least one removable storage container to the storage container support frame of the container caddy in the stored position on the container caddy to prevent the at least one removable storage container from moving out of the one of the first container-receiving space and the second container-receiving space of the container caddy when the tilt bin is moved from the retracted storage position to the extended use position so that the storage space of the tilt bin may be accessed while the at least one removable storage container is in the stored position.

In some embodiments, the container drop-in lock may include a container connector tab and a container retainer strip. The container connector tab may be coupled to the container shell of the at least one removable storage container. The container retainer strip may be coupled to the handle foundation of the container caddy. The container retainer strip may define a tab-receiving slot. The tab-receiving slot may be configured to receive the container connector tab when the at least one removable storage container is in the stored position to retain the at least one removable storage container to the storage container support frame of the container caddy.

In some embodiments, the customizable storage system may further comprise a container drop-in lock. The container drop-in lock may be configured to retain the at least one removable storage container to the storage container support frame of the container caddy in the stored position on the container caddy to prevent the at least one removable storage container from moving out of the one of the first container-receiving space and the second container-receiving space of the container caddy when the tilt bin is moved from the retracted storage position to the extended use position so that the storage space of the tilt bin may be accessed while the at least one removable storage container is in the stored position.

In some embodiments, the container drop-in lock may include a container connector tab and a container retainer strip. The container connector tab may be coupled to the container shell of the at least one removable storage container. The container retainer strip may be coupled to the handle foundation of the container caddy.

In some embodiments, the container retainer strip may define a tab-receiving slot. The tab-receiving slot may be configured to receive the container connector tab when the at least one removable storage container is in the stored position to retain the at least one removable storage container to the storage container support frame of the container caddy.

In some embodiments, the storage unit may further comprise a plurality of storage containers, a first container rotary lock, and a second container rotary lock. The plurality of storage containers may include a first pair of storage containers and a second pair of storage containers. The first pair of storage containers may be configured to be arranged in the first container-receiving space of the first container dock. The second pair of storage containers may be configured to be arranged in the second container-receiving space of the second container dock. The first container rotary lock may be configured to block tilting of the tilt bins included in the first pair of storage containers relative to the respective container shells from the retracted storage position to the extended use position. The first container rotary lock may be configured to block movement of the first pair of storage containers relative to the container caddy when the first container rotary lock is in the locked position. The second container rotary lock may be configured to block tilting of the tilt bins included in the second pair of storage containers relative to the respective container shells from the retracted storage position to the extended use position. The second container rotary lock may be configured to block movement of the second pair of storage containers relative to the container caddy when the second container rotary lock is in the locked position.

In some embodiments, each of the first and second container rotary locks may include a lock rod, a lock knob, and a first lock arm. The lock rod may have a first end and a second end. The first end may be coupled to a first side of the container support frame. The second end may be spaced apart axially from the first end of the lock rod along an axis. The second end may be coupled to a second side of the container support frame. The lock knob may be coupled to one of the first end and the second end of the lock rod for rotation therewith. The first lock arm may extend radially from the lock rod relative to the axis.

In some embodiments, the storage unit may further comprise a container drop-in lock for each storage container included in the plurality of storage containers. The container drop-in lock may be configured to retain the respective storage container to the storage container support frame of the container caddy in the stored position on the container caddy to prevent the at least one removable storage container from moving out of the respective container-receiving space of the container caddy when the tilt bin is moved from the retracted storage position to the extended use position so that the storage space of the tilt bin may be accessed while the respective storage container is in the stored position.

In some embodiments, each container drop-in lock may include a container connector tab and a container retainer strip. The container connector tab may be coupled to the container shell of the respective storage container. The container retainer strip may be coupled to one of a first side and a second side of the handle foundation of the container caddy. The container retainer strip may define a tab-receiving slot. The tab-receiving slot may be configured to receive the container connector tab when the respective storage container is in the stored position to retain the respective storage container to the storage container support frame of the container caddy.

In some embodiments, the customizable storage system may further comprise a table top attachment. The table top attachment may be configured to be vertically stacked on top of the storage unit. The table top attachment may include a table top panel and table support legs. The table support legs may be pivotally coupled to the table top panel to change between a retracted stowed position and an extended supporting position. In the retracted stowed position, the table support legs may confront the table top panel. In the extended supporting position, the table support legs may extend perpendicular to the table top panel so as to engage the at least one removable storage container when the table top attachment is vertically stacked on top of the storage unit.

In some embodiments, the carrying handle may include a main handle body and attachment arms. The main handle body may be coupled to and may extend away from the handle foundation of the container support frame. The attachment arms may be pivotally coupled the main handle body to pivot between a retracted handle position and an extended attachment position. In the retracted handle position, the attachment arms may be received in a groove formed in the main handle body of the carrying handle so that the attachment arms are flush with upper edges of the main handle body. In the extended attachment position, the attachment arms may extend upwardly from the main handle body of the carrying handle at a 90 degree angle relative to the main handle body of the carrying handle.

In some embodiments, each attachment arm may be formed to include a projecting edge. The projecting edge may be configured to mate with an opening formed in the table top panel of the table top attachment to secure the table top attachment with the storage unit in a table mode such that a topside of the table top panel provides a support surface.

According to another aspect of the present disclosure, a customizable storage unit may comprise at least one storage container, a container caddy, and at least one container rotary lock. The at least one storage container may include a container shell and a tilt bin. The tilt bin may be located in the container shell. The tilt bin may be formed to include an aperture. The aperture may be arranged to open into a storage space formed in the tilt bin. The tilt bin may be configured to tilt relative to the container shell between a retracted storage position and an extended use position. In the retracted storage position, the container shell may block access to the storage space of the tilt bin through the aperture. In the extended use position, the tilt bin may be tilted away from the container shell to allow access to the storage space through the aperture.

In some embodiments, the container caddy may include a container support frame. The container support frame may have a first container dock, a second container dock, a handle foundation, and a carrying handle. The first container dock may define a first container-receiving space configured to receive the at least one storage container. The second container dock may be spaced apart from the first container dock. The second container dock may define a second container-receiving space configured to receive the at least one storage container. The handle foundation may extend between and interconnect the first container dock and the second container dock. The carrying handle may be coupled to and extending away from the handle foundation of the container support frame.

In some embodiments, the at least one container rotary lock may be configured to rotate between an unlocked position and a locked position. In the unlocked position, the tilt bin of the at least one storage container may be free to change between the retracted storage position and the extended use position. In the locked position, the tilt bin may be blocked from tilting relative to the container shell from the retracted storage position to the extended use position to prevent unwanted access to the storage space of the tilt bin through the aperture.

In some embodiments, the at least one container rotary lock may include a lock rod, a lock knob, and a lock arm. The lock rod may have a first end and a second end. The first end may be coupled to a first side of the container support frame. The second end may be spaced apart axially from the first end of the lock rod along an axis. The second end may be coupled to a second side of the container support frame. The lock knob may be coupled to one of the first end and the second end of the lock rod for rotation therewith. The lock arm may extend radially from the lock rod relative to the axis. The lock arm may be configured to engage the tilt bin when the at least one container lock is in the locked position.

In some embodiments, the customizable storage unit may further comprise a container drop-in lock. The container drop-in lock may be configured to retain the at least one storage container to the storage container support frame of the container caddy in a stored position on the container caddy to prevent the at least one storage container from moving out of the one of the first container-receiving space and the second container-receiving space of the container caddy when the tilt bin is moved from the retracted storage position to the extended use position so that the storage space of the tilt bin may be accessed while the at least one storage container is in the stored position.

In some embodiments, the container drop-in lock may include a container connector tab and a container retainer strip. The container connector tab may be coupled to the container shell of the at least one storage container. The container retainer strip may be coupled to the handle foundation of the container caddy. The container retainer strip may define a tab-receiving slot. The tab-receiving slot may be configured to receive the container connector tab when the at least one storage container is in the stored position to retain the at least one storage container to the storage container support frame of the container caddy.

In some embodiments, the customizable storage unit may further comprise a plurality of storage containers, a first container rotary lock, and a second container rotary lock. The plurality of storage containers may include a first pair of storage containers and a second pair of storage containers. The first pair of storage containers may be configured to be arranged in the first container-receiving space of the first container dock. The second pair of storage containers may be configured to be arranged in the second container-receiving space of the second container dock. The first container rotary lock may be configured to block tilting of the tilt bins included in the first pair of storage containers relative to the respective container shells from the retracted storage position to the extended use position when the first container rotary lock is in the locked position. The second container rotary lock may be configured to block tilting of the tilt bins included in the second pair of storage containers relative to the respective container shells from the retracted storage position to the extended use position when the second container rotary lock is in the locked position.

In some embodiments, each of the first and second container rotary locks includes a lock rod, a lock knob, and a first lock arm. The lock rod may have a first end and a second end. The first end may be coupled to a first side of the container support frame. The second end may be spaced apart axially from the first end of the lock rod along an axis. The second end may be coupled to a second side of the container support frame. The lock knob may be coupled to one of the first end and the second end of the lock rod for rotation therewith. The first lock arm may extend radially from the lock rod relative to the axis.

In some embodiments, the customizable storage unit may further comprise a container drop-in lock for each storage container included in the plurality of storage containers. The container drop-in lock may be configured to retain the respective storage container to the storage container support frame of the container caddy in a stored position on the container caddy to prevent the at least one storage container from moving out of the respective container-receiving space of the container caddy when the tilt bin is moved from the retracted storage position to the extended use position so that the storage space of the tilt bin may be accessed while the respective storage container is in the stored position. Each container drop-in lock may include a container connector tab and a container retainer strip. The container connector tab may be coupled to the container shell of the respective storage container. The container retainer strip may be coupled to one of a first side and a second side of the handle foundation of the container caddy. The container retainer strip may define a tab-receiving slot. The tab-receiving slot may be configured to receive the container connector tab when the respective storage container is in the stored position to retain the respective storage container to the storage container support frame of the container caddy.

Additional features, which alone or in combination with any other feature(s), such as those listed above and/or those listed in the claims, can comprise patentable subject matter and will become apparent to those skilled in the art upon consideration of the following detailed description of various embodiments exemplifying the best mode of carrying out the embodiments as presently perceived.

BRIEF DESCRIPTION OF THE DRAWINGS

The detailed description particularly refers to the accompanying figures in which.

DETAILED DESCRIPTION OF THE DRAWINGS

Although this disclosure refers to specific embodiments, it will be understood by those skilled in the art that various changes in form and detail may be made without departing from the subject matter set forth in the accompanying claims.

Figure 3:
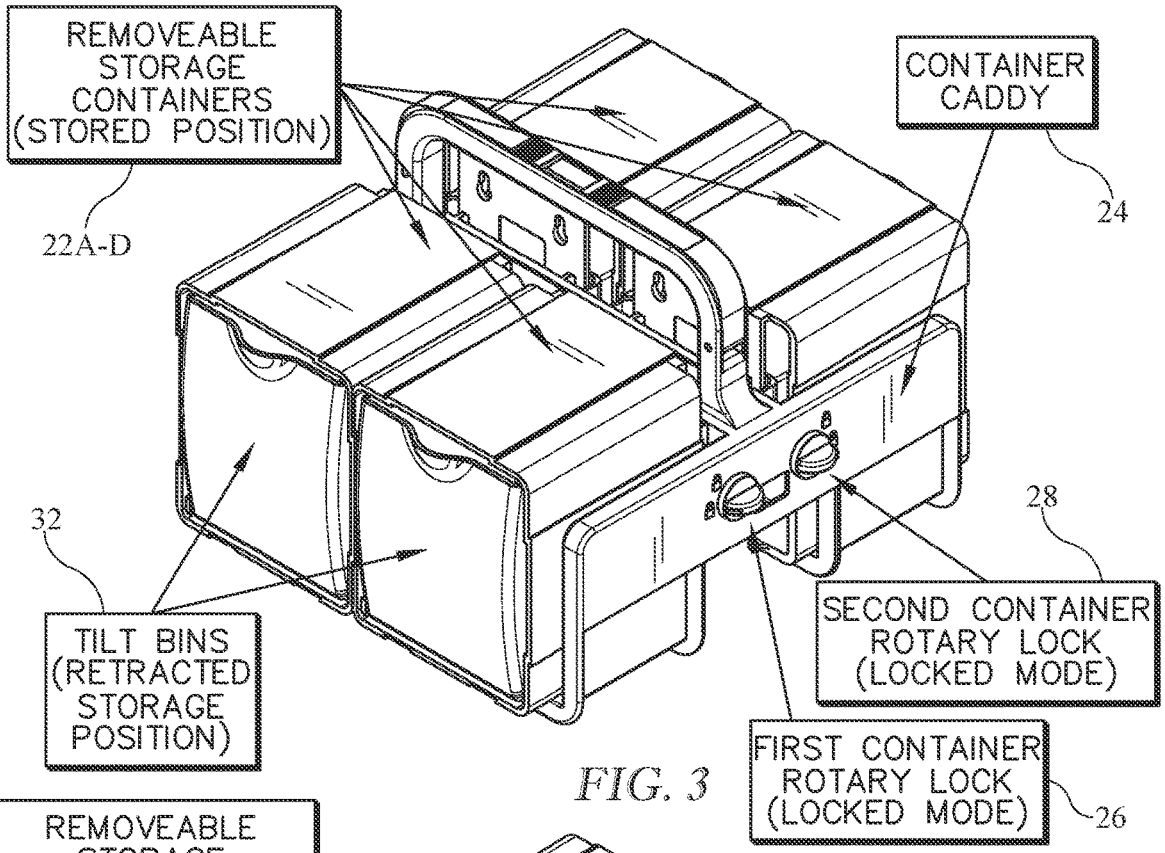
FIG. 3 is a perspective view of the storage unit of FIG. 1 showing the first and second rotary locks in the locked mode in which the tilt bins of each of the storage containers is blocked in the retracted storage position and each of the storage containers is blocked from being removed from the container-receiving spaces of the container caddy.
Figure 4:
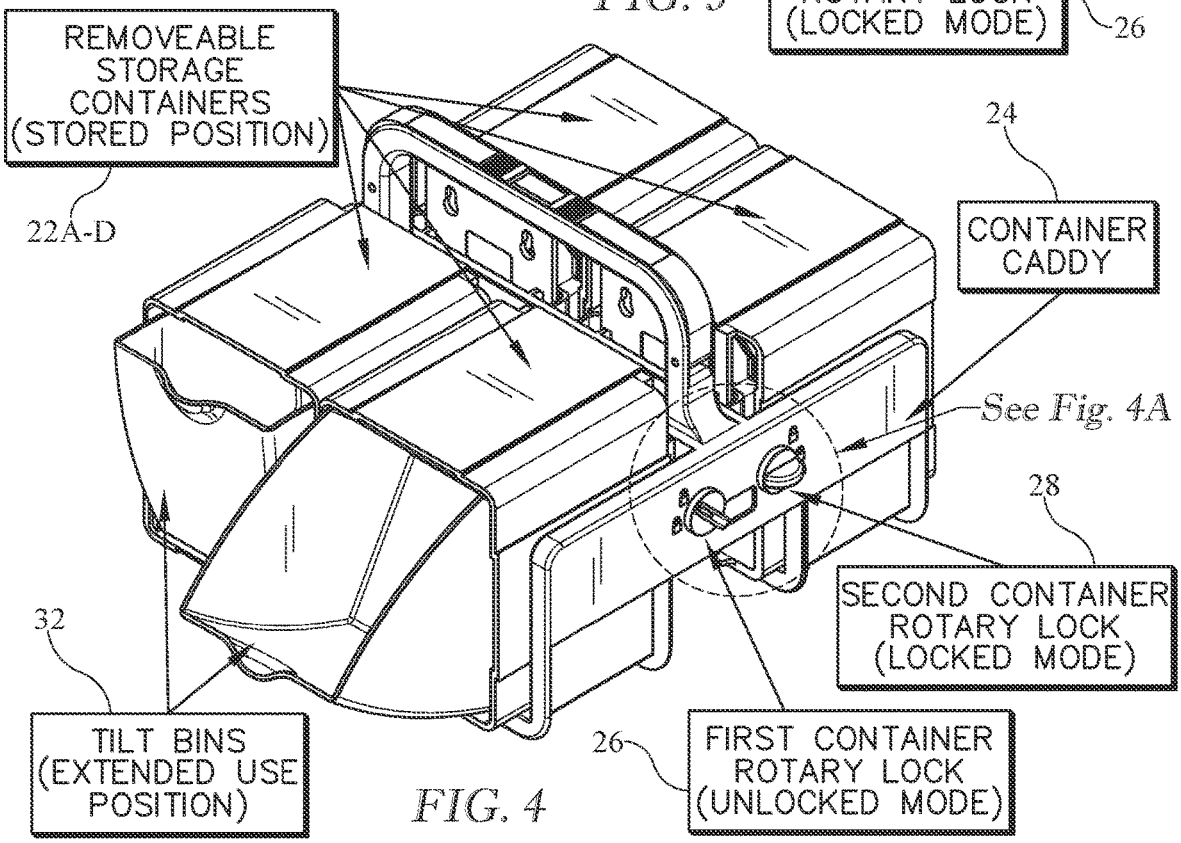
FIG. 4 is a view similar to FIG. 3 showing the first rotary lock has changed from the locked mode as shown in FIG. 3 to the unlocked mode in which the tilt bins of the respective storage containers are free to move from the retracted storage position to the extended use position.
Figure 5:
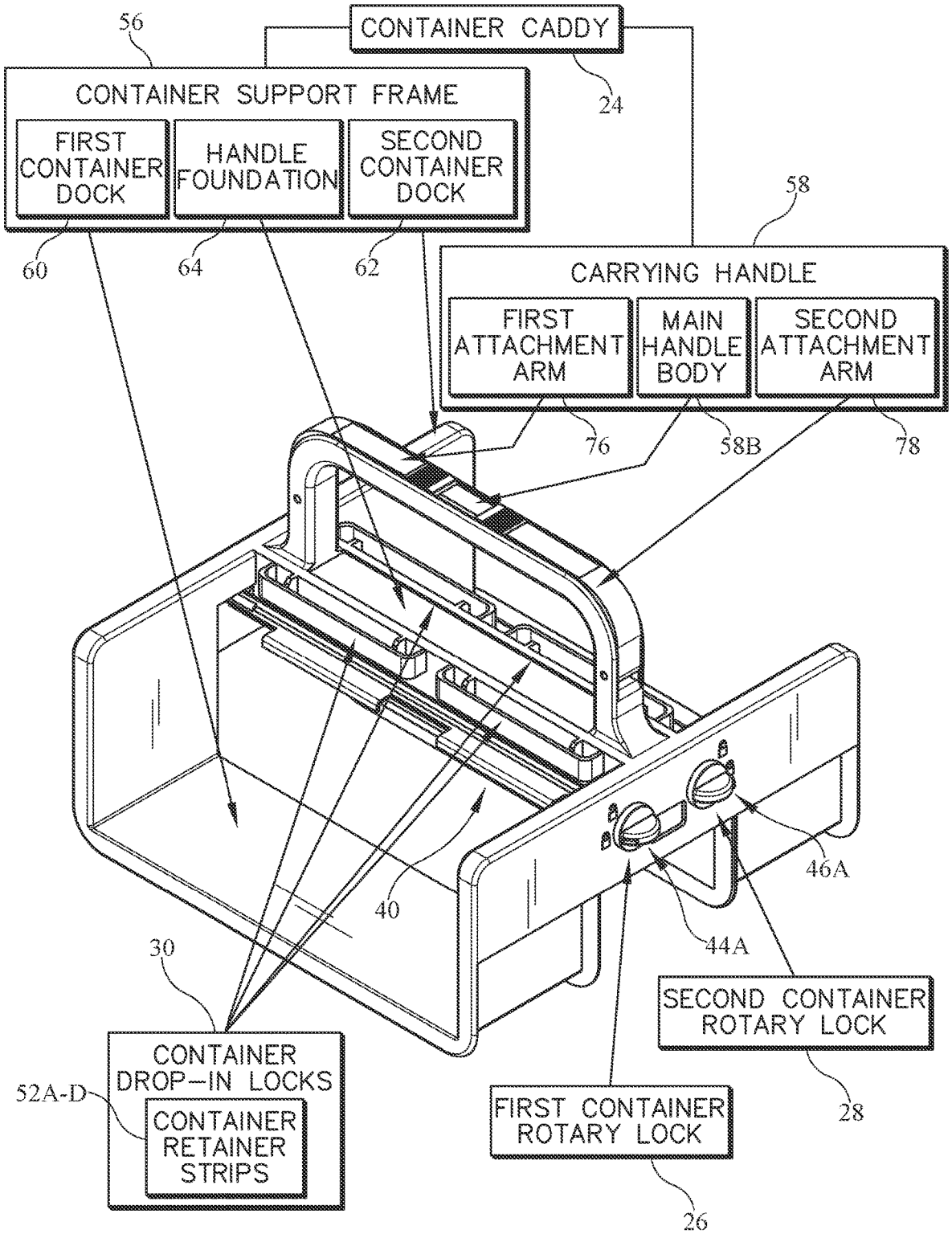
FIG. 5 is perspective view of the container caddy included in the storage unit of FIG. 1 showing the container caddy includes a carrying handle and a container support frame having a first container dock that defines the first container-receiving space, a second container dock that defines the second container-receiving space, and a handle foundation that extends between and interconnects the first container dock and the second container dock, and further showing each of the container drop-in locks includes a container retainer strip coupled to the handle foundation to form tab-receiving slots.
Figure 6:
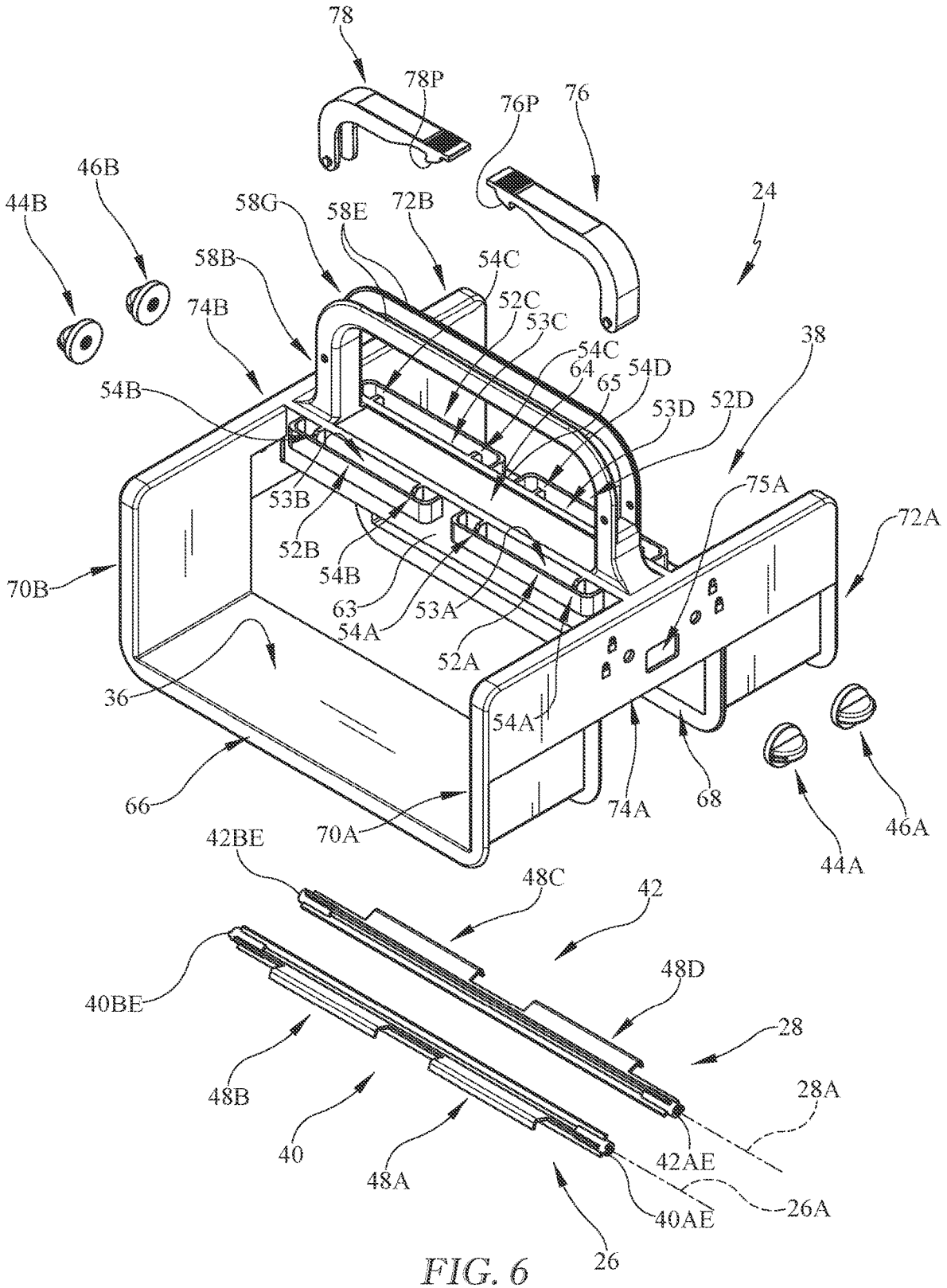
FIG. 6 is an exploded view of the container caddy of FIG. 5 showing each rotary container lock includes a lock rod that has two ends spaced apart axially along an axis, lock control knobs configured to be coupled to a corresponding end of the lock rod for rotation therewith, and lock arms for each storage container that each extend radially from the corresponding lock rod relative to the axis.
Figure 7:
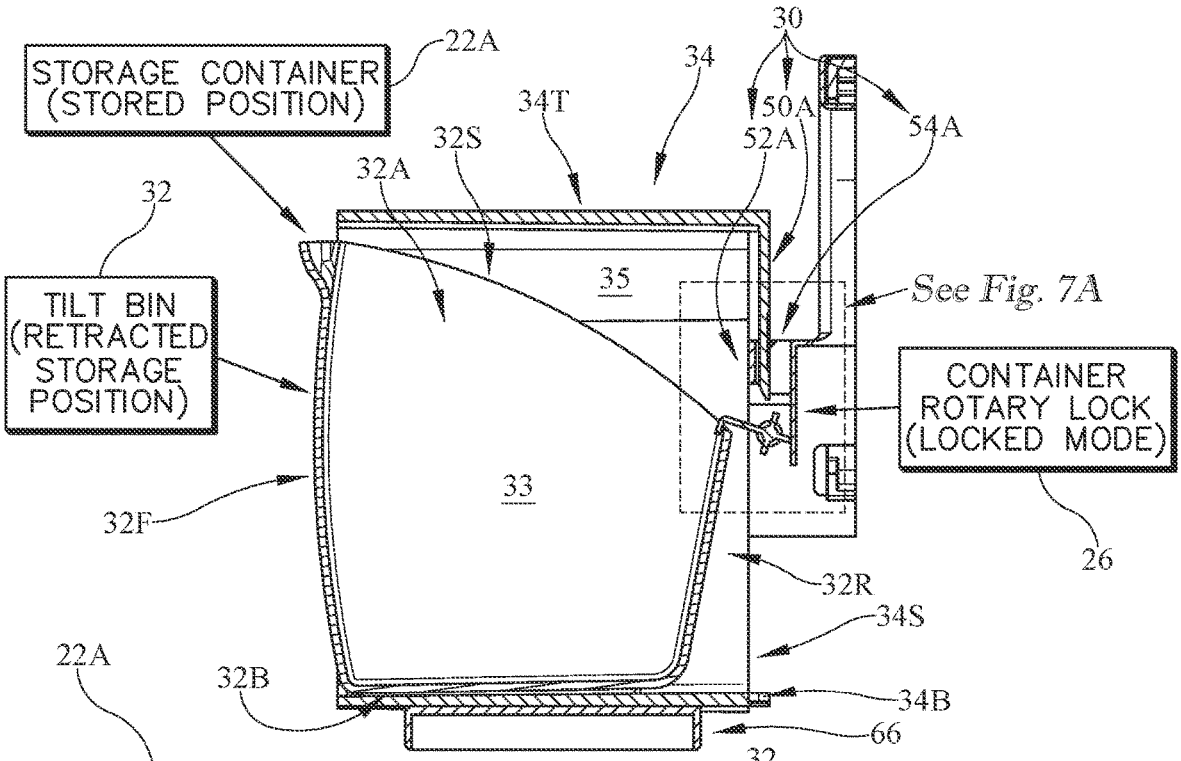
FIG. 7 is a cross-section view of the storage unit of FIG. 3 showing one of the container rotary locks is in the locked mode in which the lock arm of the container rotary lock engages the tilt bin of the respective storage container when the storage container is in the stored position to block removal of the storage container and to block the tilt bin from moving relative to the container shell from the retracted storage position and the extended use position.
Figure 8:
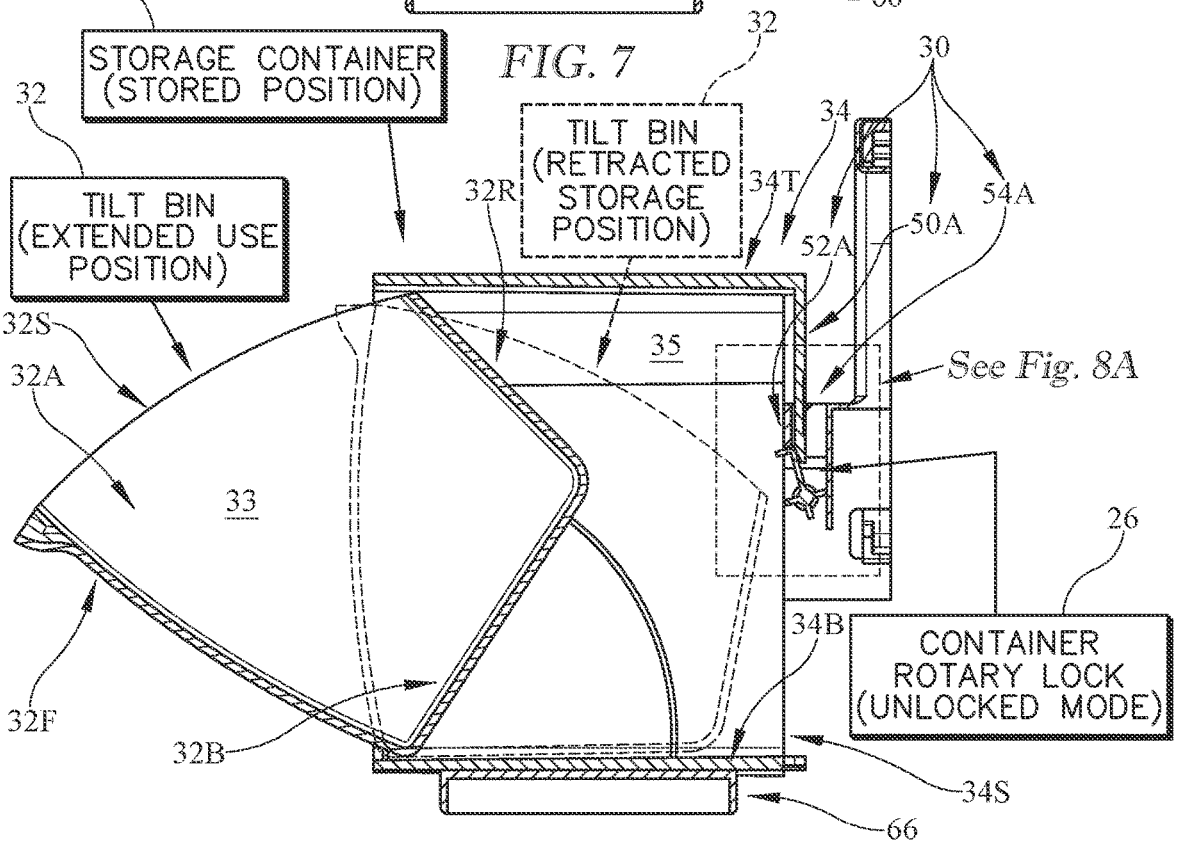
FIG. 8 is a cross-section view of the storage unit of FIG. 4 showing the container rotary lock has moved from the locked mode to the unlocked mode in which the lock arm of the container rotary lock is spaced apart from the tilt bin of the respective storage container to allow the tilt bin to change from the retracted storage position to the extended use position and to allow removal of the storage container from the container caddy as shown in FIGS. 9 and 10.

An illustrative a storage unit 20 adapted for use in a customizable storage system 10 is shown in FIGS. 1-10. The storage unit 20 includes a plurality of removable storage containers 22A, 22B, 22C, 22D, a container caddy 24, first and second container rotary locks 26, 28, and a container drop-in lock 30 for each storage container 22A, 22B, 22C, 22D as shown in FIGS. 1-6. Each of the storage containers 22A, 22B, 22C, 22D includes a container shell 34 and a tilt bin 32 located in the container shell 34 to tilt relative to the container shell 34 between a retracted storage position as shown in FIGS. 3 and 7 and an extended use position as shown in FIGS. 4 and 8. The container caddy 24 is formed to define first and second container-receiving spaces 36, 38 that each receive at least two storage containers 22A, 22B, 22C, 22D. The first and second container rotary locks 26, 28 and the container drop-in locks 30 are configured to control access to the storage containers 22A, 22B, 22C, 22D and help retain and anchor the storage containers 22A, 22B, 22C, 22D on the container caddy 24.

The first and second container rotary locks 26, 28 are configured to change between an unlocked mode as shown in FIGS. 4 and 8 and a locked mode as shown in FIGS. 3 and 7 to control access to the storage containers 22A, 22B, 22C, 22D. In the unlocked mode, the tilt bin 32 of the respective storage container 22A, 22B, 22C, 22D is free to change between the retracted storage position and the extended use position and the respective storage container 22A, 22B, 22C, 22D is free to be removed from the respective container-receiving space 36, 38 of the container caddy 24. In the locked mode, the tilt bin 32 is blocked from tilting relative to the container shell 34 of the respective storage container 22A, 22B, 22C, 22D from the retracted storage position to the extended use position to prevent unwanted access to a storage space 33 of the tilt bin 32 through an aperture 32A of the tilt bin 32.

The respective storage containers 22A, 22B, 22C, 22D are also blocked from moving relative to the container caddy 24 from a stored position on the container caddy 24 while the respective container rotary lock 26, 28 is in the locked position as shown in FIGS. 3 and 7. This prevents unwanted removal of the respective storage container 22A, 22B, 22C, 22D from the respective container-receiving space 36, 38 of the container caddy 24.

To be able to tilt each of the tilt bins 32 of the storage containers 22A, 22B, 22C, 22D between the retracted storage position and the extended use position while the storage containers 22A, 22B, 22C, 22D are located in one of the first and second container-receiving spaces 36, 38, the container caddy 24 is open on each side as shown in FIGS. 3 and 4. In this way, no part of the container support frame 56 blocks the tilt bins 32 from being able to move between the retracted and extended positions when the first and second container rotary locks 26, 28 are in the unlocked mode as shown in FIG. 4.

Because the container support frame 56 is open on each side, the storage unit 20 includes the container drop-in locks 30 to retain the storage containers 22A, 22B, 22C, 22D in the stored position on the container caddy 24. Each of the container drop-in locks 30 is configured to retain the respective storage container 22A, 22B, 22C, 22D in the stored position on the container caddy 24. This prevents the respective storage containers 22A, 22B, 22C, 22D from falling out of the container-receiving spaces 36, 38.

Additionally, each of the container drop-in locks 30 anchors each of the respective storage containers 22A, 22B, 22C, 22D so that the respective storage container 22A, 22B, 22C, 22D is blocked from moving out of the respective container-receiving space 36, 38 of the container caddy 24 when the tilt bin 32 is moved from the retracted storage position to the extended use position. Otherwise, movement of the tilt bin 32 between the retracted and extended positions would cause the respective storage container 22A, 22B, 22C, 22D to fall out of the respective container-receiving space 36, 38 of the container caddy 24. Further, each of the container drop-in locks 30 is configured to retain the respective storage container 22A, 22B, 22C, 22D on the container caddy 24 in the stored position regardless of whether the first and second container rotary locks 28A, 28B are in the unlocked or locked modes.

Each container rotary lock 26, 28 includes a lock rod 40, 42, lock control knobs 44A, 44B, 46A, 46B, and lock arms 48A, 48B, 48C, 48D as shown in FIGS. 5 and 6. The lock rod 40, 42 has a first end 40AE, 42AE and a second end 40BE, 42BE spaced apart axially from the first end first end 40AE, 42AE of the lock rod 40, 42 along an axis 26A, 28A of the corresponding rotary lock 26, 28. The first end 40AE, 42AE of the lock rod 40, 42 is rotably coupled to a first end of the container caddy 24, while the second end 40BE, 42BE of the lock rod 40, 42 is rotably coupled to a second end of the container caddy 24. Each of the lock control knobs 44A, 44B, 46A, 46B is coupled to the corresponding end 40AE, 40BE, 42AE, 42BE of the lock rod 40, 42 for rotation therewith. Each of the lock arms 48A, 48B, 48C, 48D extends radially from the corresponding lock rod 40, 42 relative to the axis 26A, 28A.

In the illustrative embodiment, the first and second lock arms 48A, 48B extend from the first lock rod 40 and are spaced apart axially from one another. The third and fourth lock arms 48C, 48D extend from the second lock rod 42 and are spaced apart axially from one another.

Each of the lock arms 48A, 48B, 48C, 48D is configured to engage the tilt bin 32 of the corresponding storage container 22A, 22B, 22C, 22D when the corresponding rotary lock 26, 28 is in the locked mode. Each of the lock arms 48A, 48B, 48C, 48D on the corresponding lock rod 40, 42 engage the pair of storage containers 22A, 22B, 22C, 22D in the respective container-receiving space 36, 38.

For instance, the lock arms 48A, 48B of the first container rotary lock 26 engage the first pair of storage containers 22A, 22B. The first lock arm 48A engages the first storage container 22A, while the second lock arm 48B engages the second storage container 22B.

Similarly, the lock arms 48C, 48D of the second container rotary lock 28 engage the second pair of the storage containers 22C, 22D. The third lock arm 48C engages the third storage container 22C, while the fourth lock arm 48D engages the fourth storage container 22D.

Figure 7A:
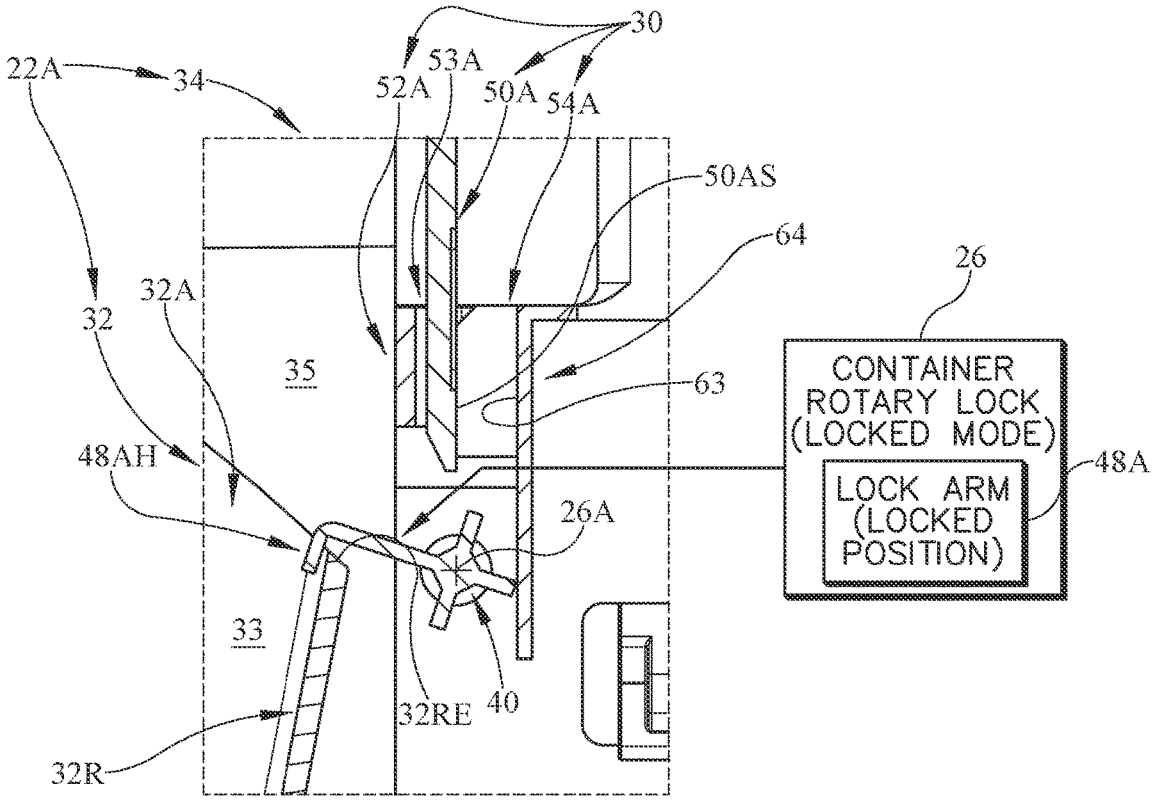
FIG. 7A is a detail view of FIG. 7 showing the lock arm of the container rotary lock in the locked position when the container rotary lock is in the locked mode.

Rotation of the first rotary lock 26 causes both lock arms 44A, 44B to move between the locked and unlocked positions. Therefore, in the locked position as shown in FIG. 7A, the first lock arm 48A engages the first storage container 22A and the second lock arm 48B engages the second storage container 22B. In this way, in the locked mode, both tilt bins 32 of the first and second storage containers 22A, 22B are blocked from tilting and the first and second storage containers 22A, 22B are blocked from moving out of the container-receiving space 36.

Similarly, rotation of the second rotary lock 28 causes both lock arms 48C, 48D to move between the locked and unlocked positions. Therefore, in the locked position, the third lock arm 48C engages the third storage container 22C and the fourth lock arm 48D engages the fourth storage container 22D. In this way, in the locked mode, both tilt bins 32 of the third and fourth storage containers 22C, 22D are blocked from tilting and the third and fourth storage containers 22C, 22D are blocked from moving out of the container-receiving space 38.

Figures 1, 2:
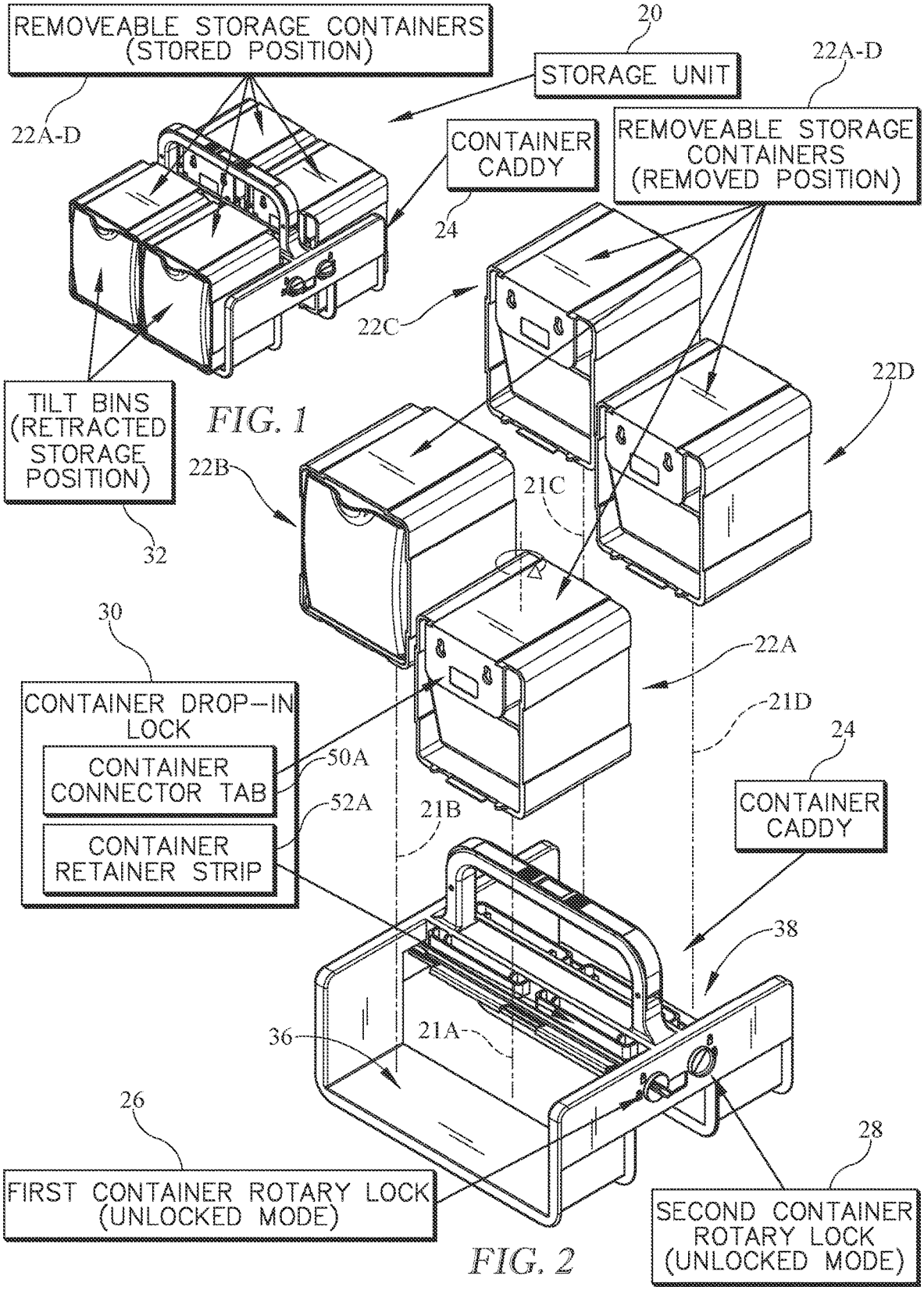
FIG. 1 is a perspective view of a storage unit including a container caddy and a plurality of removable storage containers located in container-receiving spaces formed by the container caddy that each include an container shell and a tilt bin located in the container shell to pivot between a retracted storage position as shown in FIG. 3 and an extended use position as shown in FIG. 4.
FIG. 2 is an exploded view of the storage unit of FIG. 1 before the plurality of storage containers are located in the container-receiving spaces of the container caddy showing the storage unit further includes a container drop-in lock for each storage container configured to retain the respective storage container to the container caddy in a stored position as shown in FIGS. 3 and 4 and first and second rotary locks configured to change between a locked mode as shown in FIGS. 3 and 7 and an unlocked mode as shown in FIGS. 4 and 8.

Each of the container drop-in locks 30 includes a container connector tab 50A, 50B, 50C, 50D and container retainer strip 52A, 52B, 52C, 52D as shown in FIGS. 2, 5, and 6. The container connector tab 50A, 50B, 50C, 50D is coupled to the container shell 34 of the corresponding storage container 22A, 22B, 22C, 22D. The container retainer strip 52A, 52B, 52C, 52D is coupled to a portion of the container caddy 24 to define a tab-receiving slot 53A, 53B, 53C, 53D. The tab-receiving slot 53A, 53B, 53C, 53D is configured to receive the container connector tab 50A, 50B, 50C, 50D when the corresponding storage container 22A, 22B, 22C, 22D is in the stored position.

To engage the container drop-in locks 30, the corresponding storage container 22A, 22B, 22C, 22D is dropped into the respective container-receiving space 36, 38 so that the container connector tab 50A, 50B, 50C, 50D extends into the tab-receiving slot 53A, 53B, 53C, 53D of the respective container retainer strip 52A, 52B, 52C, 52D. The container retainer strip 52A, 52B, 52C, 52D engages with the corresponding container connector tab 50A, 50B, 50C, 50D to retain the corresponding storage container 22A, 22B, 22C, 22D to the container caddy, blocking movement out of the respective container-receiving space 36, 38.

Figure 8A:
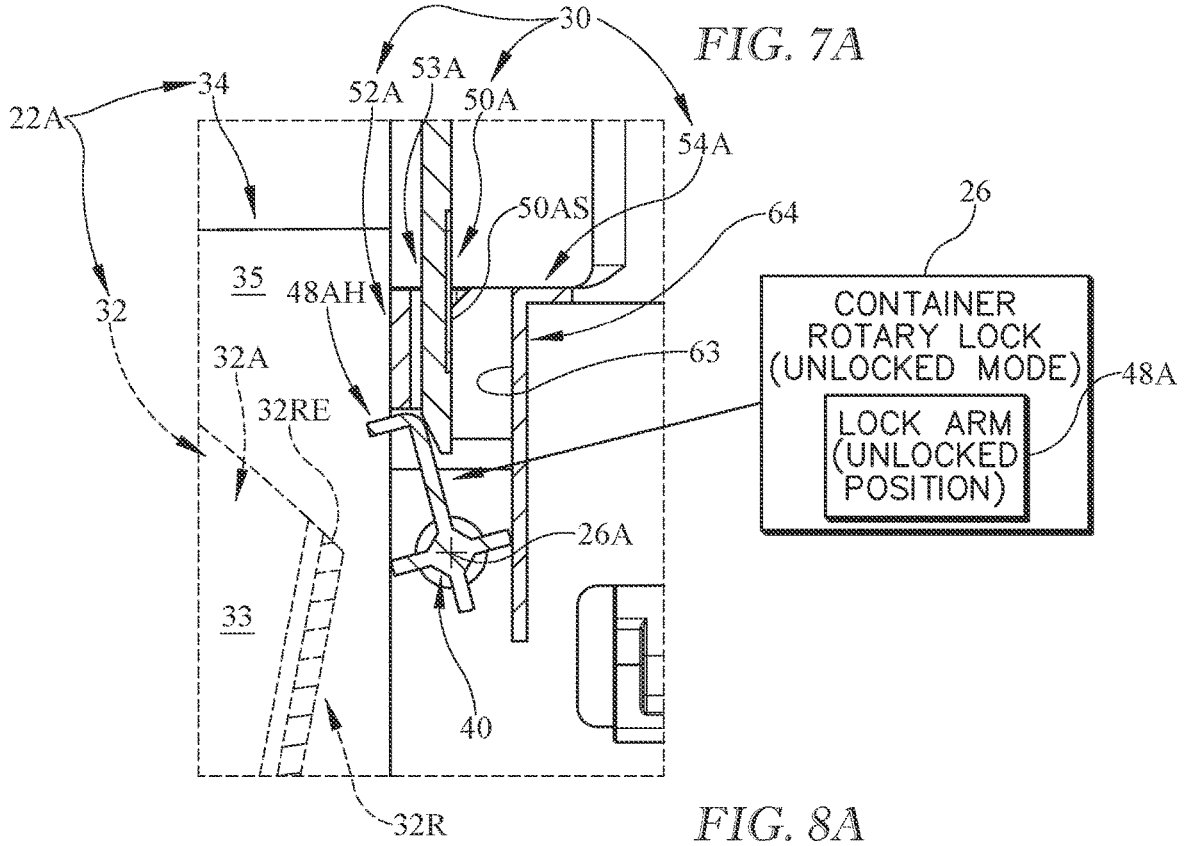
FIG. 8A is a detail view of FIG. 8 showing the lock arm of the container rotary lock in the unlocked position when the container rotary lock is in the unlocked mode.

In the illustrative embodiment, each of the container drop-in locks 30 includes container stabilizer protrusions 54A, 54B, 54C, 54D as shown in FIGS. 3, 7A, and 7B. Each of the container stabilizer protrusions 54A, 54B, 54C, 54D extends from the portion of the container caddy 24 into the corresponding tab-receiving slot 53A, 53B, 53C, 53D. When the container connector tab 50A is inserted into the corresponding tab-receiving slot 53A of the respective container retainer strip 52A, the respective container stabilizer protrusions 54A engage a rear surface 50AS of the container connector tab 50A like as shown in FIGS. 7A and 8A. The respective container stabilizer protrusions 54A, 54B, 54C, 54D engage the container connector tab 50A, 50B, 50C, 50D to help stabilize the respective storage container 22A, 22B, 22C, 22D in the storage position.

Turning again to the storage containers 22A, 22B, 22C, 22D, the plurality of storage containers 22A, 22B, 22C, 22D includes a first set of storage containers 22A, 22B configured to be arranged in the first container-receiving space 36 and a second set of storage containers 22C, 22D configured to be arranged in the second container-receiving space 38 as shown in FIG. 2. In the illustrative embodiment, the first set of storage containers 22A, 22B is a pair of storage containers 22A, 22B including a first storage container 22A and a second storage container 22B and the second set of storage containers 22C, 22D is another pair of storage containers 22C, 22D including a third storage container 22C and a fourth storage container 22D. In other embodiments, the first set of storage containers 22A, 22B and the second set of storage containers 22C, 22D may include more than two storage containers.

When the first container rotary lock 26 is in the locked mode, the first container rotary lock 26 is configured to block tilting of the tilt bins 32 included in the first set of storage containers 22A, 22B relative to the respective container shells 34 and block movement of the first pair of storage containers 22A, 22B relative to the container caddy 24. Similarly, the second container rotary lock 28 is configured to block tilting of the tilt bins 32 included in the second pair of storage containers 22C, 22D relative to the respective container shells 34 and to block movement of the second pair of storage containers 22C, 22D relative to the container caddy 24 when the second container rotary lock 28 is in the locked mode. In this way, access to the first set of storage containers 22A, 22B is controlled independently to the second set of storage containers 22C, 22D.

Each storage container 22A, 22B, 22C, 22D includes the tilt bin 32 and the container shell 34 as shown in FIGS. 3 and 4. The tilt bin 32 includes the front wall 32F, a rear wall 32R, side walls 32S, and a bottom wall 32B that define the storage space 33 of the tilt bin 32 as shown in FIGS. 7 and 8. The container shell 34 includes a top wall 34T, a side wall 34S, and a bottom wall 34B that define a cavity 35 that receives the tilt bin 32.

In the illustrative embodiment, the container shell 34 is open in the front and rear of the container shell 34 so that the rear wall 32R of the tilt bin 32 is exposed as shown in FIGS. 7 and 8. The container rotary lock 26 extends through the opening in the rear of the container shell 34 to engage the tilt bin 32 when the container rotary lock 26 is in the locked mode as shown in FIGS. 7 and 7A.

Each of the storage containers 22A, 22B, 22C, 22D may be independently installed in the storage position on the container caddy 24 by dropping the respective storage container 22A, 22B, 22C, 22D into the respective container-receiving space 36, 38 of the container caddy 24. Each storage container 22A, 22B, 22C, 22D is dropped-in along a container axis 21A, 21B, 21C, 21D as shown in FIG. 2.

In the illustrative embodiment, the container connector tab 50A extends inward from the top wall 34T of the container shell 34 toward the bottom wall 34B of the container shell 34 as shown in FIGS. 7 and 8. In this way, when the corresponding storage container 22A, 22B, 22C, 22D is dropped into the respective container-receiving space 36, 38 along the container axis 21A, 21B, 21C, 21D, the container connector tab 50A, 50B, 50C, 50D extends into the tab-receiving slot 53A, 53B, 53C, 53D of the respective container retainer strip 52A, 52B, 52C, 52D.

The container caddy 24 includes a container support frame 56 and the carrying handle 58 as shown in FIGS. 5 and 6. The container support frame 56 has a first container dock 60 that defines the first container-receiving space 36, a second container dock 62 spaced apart from the first container dock 60 that defines the second container-receiving space 38, and a handle foundation 64 that extends between and interconnects the first container dock 60 and the second container dock 62. The carrying handle 58 is coupled to and extends away from the handle foundation 64 of the container support frame 56.

The container support frame 56 is open on each side as shown in FIGS. 5 and 6 so that each of the tilt bins 32 of the storage containers 22A, 22B, 22C, 22D is able to tilt between the retracted storage position and the extended use position while the storage containers 22A, 22B, 22C, 22D are in the storage position. The rear side of each storage container 22A, 22B, 22C, 22D faces the handle foundation 64 of the container caddy 24 so that the front wall 32F of each tilt bin 32 faces away from the handle foundation 64 of the container support frame 56 as shown in FIGS. 1-2 and 7-8. In this way, no part of the container support frame 56 blocks the tilt bins 32 from being able to move between the retracted and extended positions when the first and second container rotary locks 26, 28 are in the unlocked mode.

Because the container support frame 56 is open on each side, each of the container drop-in locks 30 prevents the respective storage containers 22A, 22B, 22C, 22D from falling out of the container-receiving spaces 36, 38. Additionally, each of the container drop-in locks 30 anchors each of the respective storage containers 22A, 22B, 22C, 22D so that the tilt bins 32 of each respective storage container 22A, 22B, 22C, 22D may move between the retracted and extended positions without the respective storage containers 22A, 22B, 22C, 22D falling out of the container-receiving spaces 36, 38.

In the illustrative embodiment, each of the container retainer strips 52A, 52B, 52C, 52D is coupled to the handle foundation 64 of the container support frame 56 as shown in FIGS. 5-8. The first and second container retainer strips 53A, 53B are coupled to a first side 63 of the handle foundation 64, while the third and fourth container retainer strips 53C, 53D are coupled to a second side 65 of the handle foundation 64 opposite the first side 63.

Each of the container stabilizer protrusions 54A, 54B, 54C, 54D extend from the handle foundation 64 of the container support frame 56 as shown in FIGS. 6-8A. The container stabilizer protrusions 54A, 54B extend from the first side 63 of the handle foundation 64, while the container stabilizer protrusions 54C, 54D extend from the second side 65 of the handle foundation 64 opposite the first side 63.

Each of the container docks 60, 62 includes a bottom dock panel 66, 68, a first vertical dock endwall 70A, 72A, and a second vertical dock endwall 70B, 72B spaced apart axially from the first vertical dock endwall 70A, 72A as shown in FIG. 6. The first and second dock endwalls 70A, 70B, 72A, 72B extend away from the corresponding bottom dock panel 66, 68 on opposite ends of the bottom dock panel 66, 68. The first dock endwall 70A, 72A is parallel to the second dock endwall 70B, 72B. The bottom dock panel 66, the first dock endwall 70A, and the second dock endwall 70B of the first container dock 60 define the first container-receiving space 36, while the bottom dock panel 68, the first dock endwall 72A, and the second dock endwall 72B of the second container dock 62 define the second container-receiving space 38.

In the illustrative embodiment, the first dock endwall 70A of the first container dock 60 is connected with the first dock endwall 72A of the second container dock 62 as shown in FIG. 6. A first side panel 74A extends between the first dock endwall 70A of the first container dock 60 and the first dock endwall 72A of the second container dock 62. The first dock endwall 70A of the first container dock 60, the first dock endwall 72A of the second container dock 62, and the first side panel 74A are integrally formed in the illustrative embodiment.

Similarly, the second dock endwall 70B of the first container dock 60 is connected with the second dock endwall 72B of the second container dock 62. A second side panel 74B extends between the second dock endwall 70B of the first container dock 60 and the second dock endwall 72B of the second container dock 62. The second dock endwall 70B of the first container dock 60, the second dock endwall 72B of the second container dock 62, and the second side panel 74B are integrally formed in the illustrative embodiment.

The first lock rod 40 of the first container rotary lock 26 extends axially between the first and second dock endwalls 70A, 70B of the first container dock 60 and the second lock rod 42 of the second container rotary lock 28 extends axially between the first and second dock endwalls 72A, 72B of the second container dock 62 as shown in FIG. 6. The first and second lock arms 48A, 48B extend radially from the first lock rod 40 away from the handle foundation 64 into the first container-receiving space 36. The third and fourth lock arms 48C, 48D extend radially from the second lock rod 42 away from the handle foundation 64 into the second container-receiving space 38.

The first and second lock control knobs 44A, 44B of the first container rotary lock 26 are coupled to the respective ends 40AE, 40BE of the lock rod 40 outside of the container-receiving space 36 as shown in FIG. 5. Similarly, the first and second lock control knobs 46A, 46B of the second container rotary lock 28 are coupled to the respective ends 42AE, 42BE of the lock rod 42 outside of the container-receiving space 38. In this way, the lock control knobs 44A, 44B, 46A, 46B are easily accessible on either end of the container caddy 24.

Figure 4A:
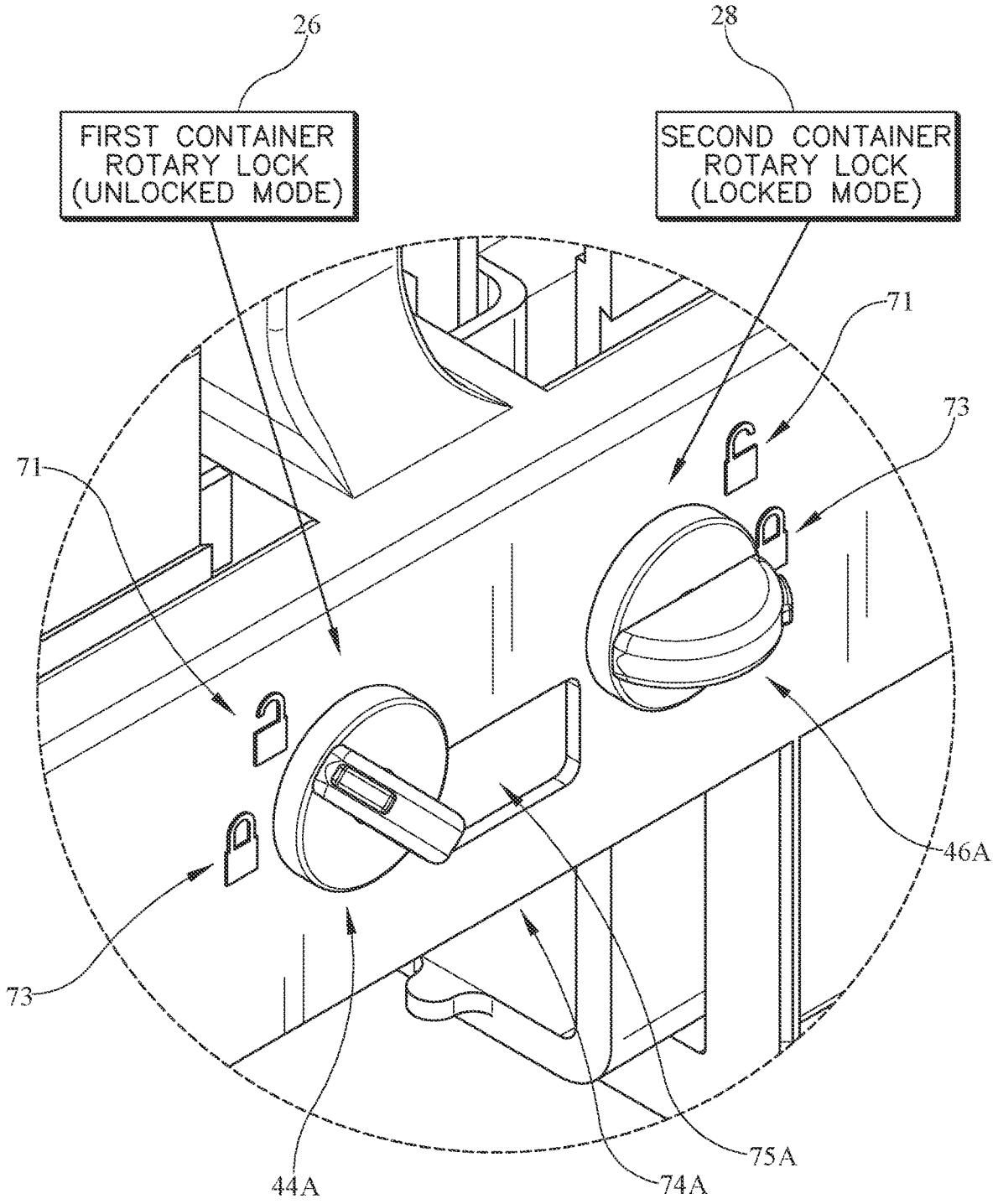
FIG. 4A is a detail view of the container caddy of FIG. 4 showing each of the container locks includes a lock control knob that changes between a locked position and an unlocked position so as to point at locked and unlocked mode indicators on the container caddy to indicate if the container lock is in the locked or unlocked modes.

In the illustrative embodiment, each of the side panels 74A, 74B is formed to include mode indicators 71, 73 as shown in FIG. 4A. The mode indicators 71, 73 are configured to indicate if the container rotary locks 26, 28 are in the unlocked mode or the locked mode. In FIG. 4A, the first container rotary lock 26 is in the unlocked mode such that the lock control knob 44A is in an unlocked position and points at the unlocked mode indicator 71. The second container rotary lock 28 is in the locked mode such that the lock control knob 46A is in a locked position and points at the locked mode indicator 73.

In FIGS. 7-10, the first storage container 22A is shown in the different modes and positions during use of the storage unit 20. The first storage container 22A is substantially similar to the other storage containers 22B, 22C, 22D and the other storage containers 22B, 22C, 22D function similarly.

In FIGS. 7 and 8, the first storage container 22A is in the stored position on the container caddy 24. When the first storage container 22A is in the stored position, the bottom wall 34B of the container shell 34 abuts the bottom dock panel 66 of the container support frame 56, the rear wall 32R faces the handle foundation 64, and the front wall 32F faces away from the handle foundation 64 as shown in FIGS. 7 and 8.

With the first storage container 22A in the stored position, the first container rotary lock 26 is in the locked mode to block the tilt bin 32 from tilting the retracted storage position to the extended use position as shown in FIG. 7. The container connector tab 50A extends into the tab-receiving slot 53A to retain the storage container 22A to the container caddy 24. The container stabilizer protrusions 54A engage the rear surface 50AS of the container connector tab 50A as shown in FIGS. 7A and 8A.

In the retracted storage position, the bottom wall 32B of the tilt bin 32 confronts the bottom wall 34B of the container shell 34 as shown in FIG. 7. In the locked position, the corresponding lock arm 48A engages the rear wall 32R of the tilt bin 32 to block tilting of the tilt bin 32 relative to the container shell 34 as shown in FIGS. 7 and 7A. The lock arm 48A extends through the opening in the rear of the container shell 34 and around an edge 32RE of the rear wall 32R of the tilt bin 32 as shown in FIG. 7A.

Figure 9:
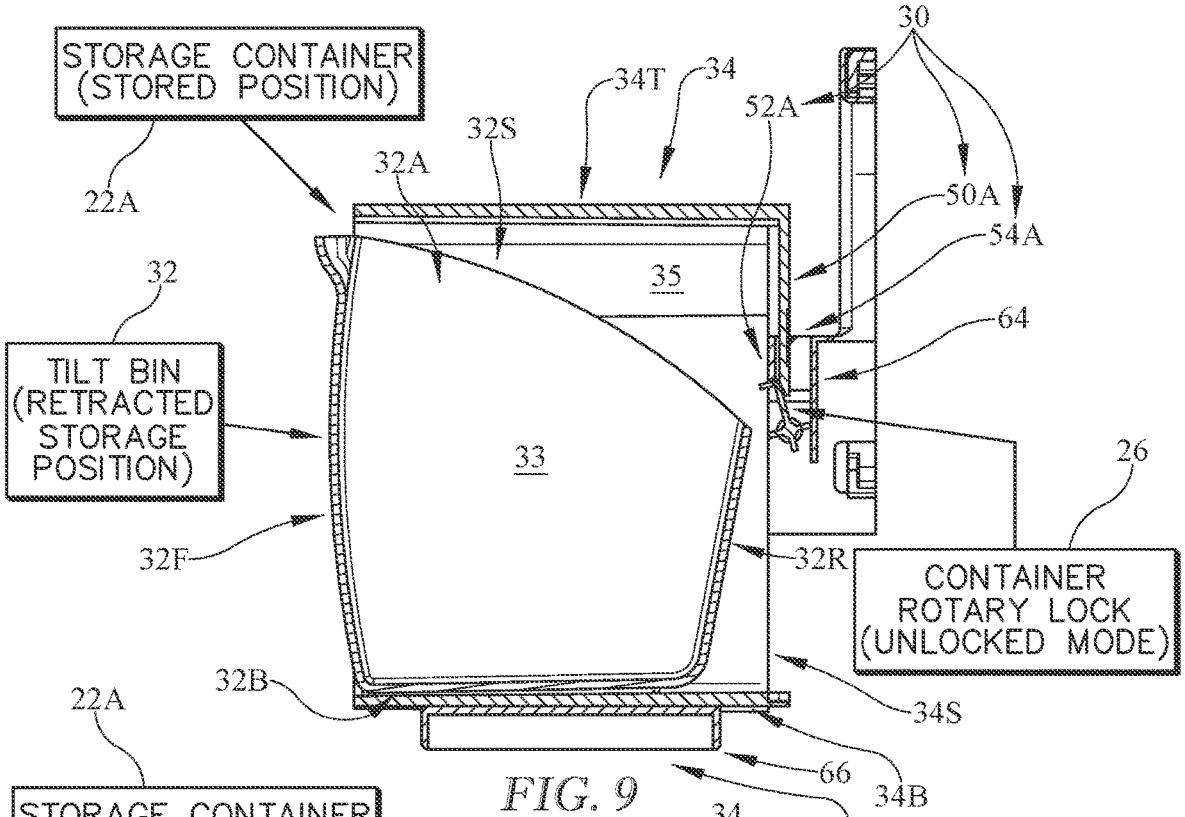
FIG. 9 is a view similar to FIG. 8 showing the storage container in the stored position with the container rotary lock in the unlocked mode to allow removal of the storage container from the container caddy as shown in FIG. 10.

In FIGS. 8 and 9, the first container rotary lock 26 has changed to the unlocked mode to allow the tilt bin 32 to tilt from the retracted storage position to the extended use position. In the extended use position, the bottom wall 32B is spaced apart from the bottom wall 34B of the container shell 34 and faces toward the handle foundation 64 as shown in FIG. 8. In the unlocked position, the corresponding lock arm 48A is spaced apart from the rear wall 32R of the tilt bin 32 so that the tilt bin 32 is free to tilt relative to the container shell 34 as shown in FIGS. 8 and 8A. The lock arm 48A is spaced apart from the edge 32RE of the rear wall 32R of the tilt bin 32 and abuts the container connector tab 50A as shown in FIG. 8A.

Figure 10:
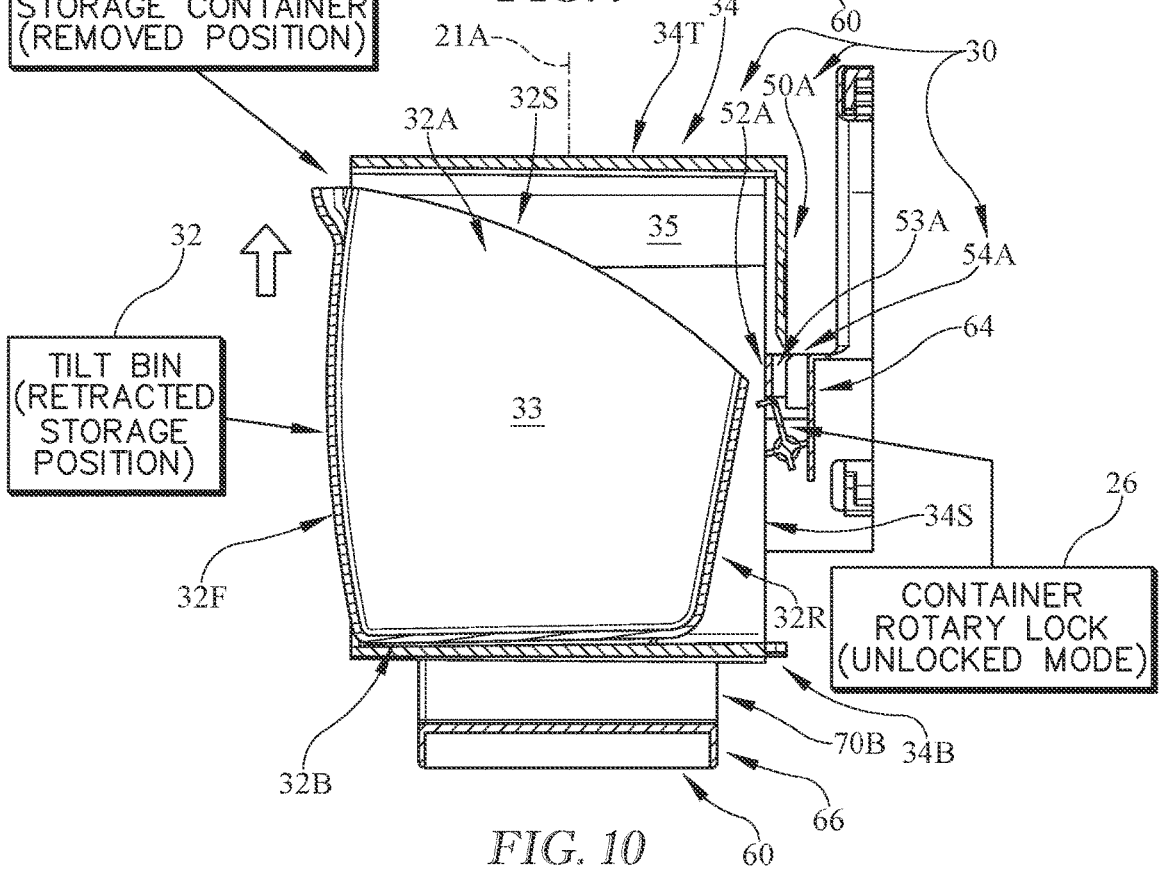
FIG. 10 is a view similar to FIG. 9 showing the storage container has been moved from the stored position as shown in FIG. 9 to the removed position in which the storage container is spaced apart from the container caddy so that the container connector tab is disengaged with the container retainer strip.

In FIG. 10, the storage container 22A has been moved from the storage position as shown in FIG. 9 to the removed position. In the removed position, the storage container 22A have been moved along the container axis 21A away from the container caddy 24 so that the container connector tab 50A is spaced apart from the container retainer strip 52A. The storage container 22A may be reassembled on the container caddy 24 by dropping in the storage container 22A along the axis 21A so that the container connector tab 50A is inserted into the tab-receiving slot 53A of the container retainer strip 52A.

Figure 11:
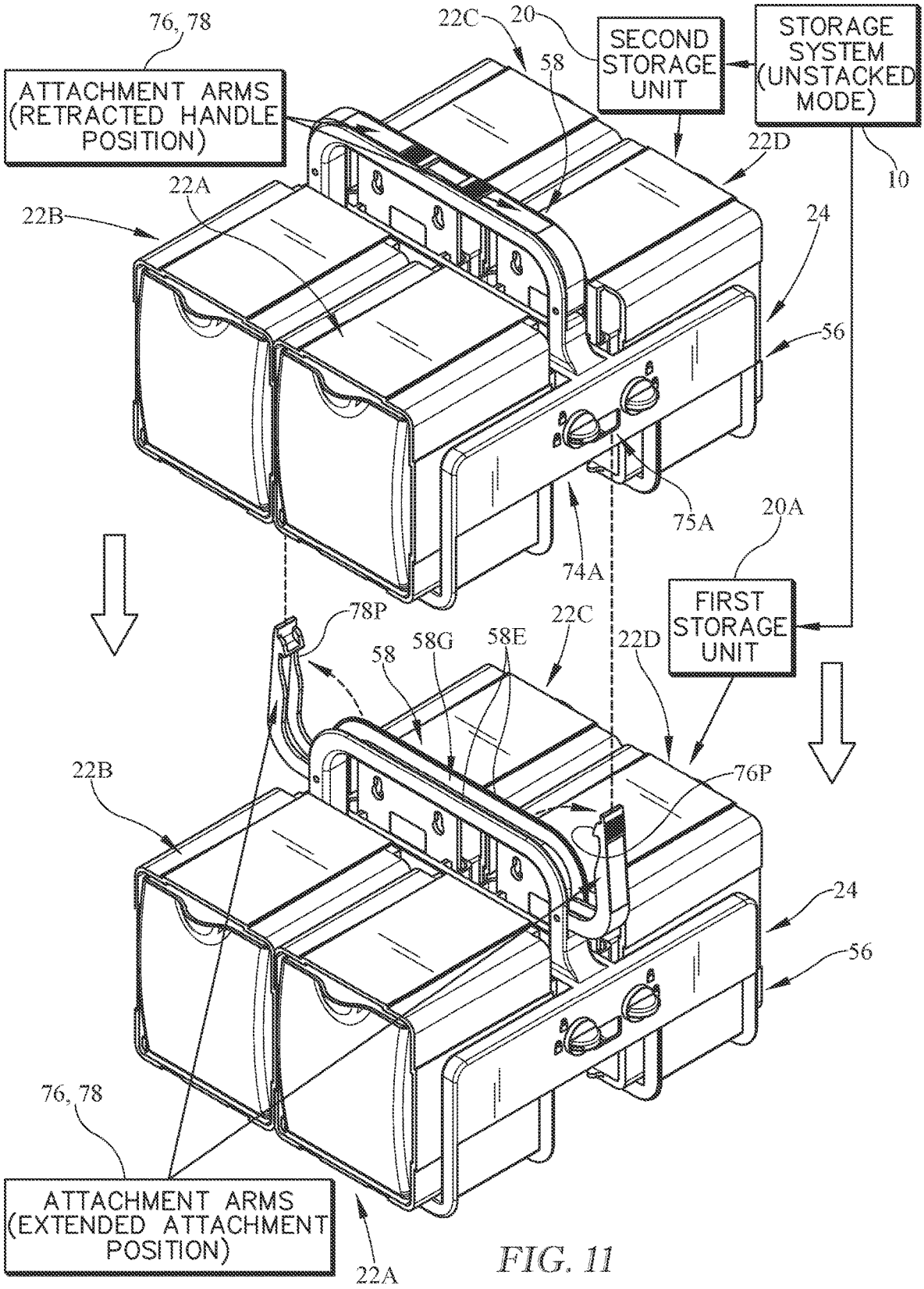
FIG. 11 is a perspective view of a first storage unit and a second storage unit included in a customizable storage system of FIG. 19 showing attachment arms included in the first storage unit are configured to change between a retracted handle position and an extended attachment position so as to engage the second storage unit about to be vertically stacked on top of the first storage unit like as shown in FIG. 12.
Figure 12:
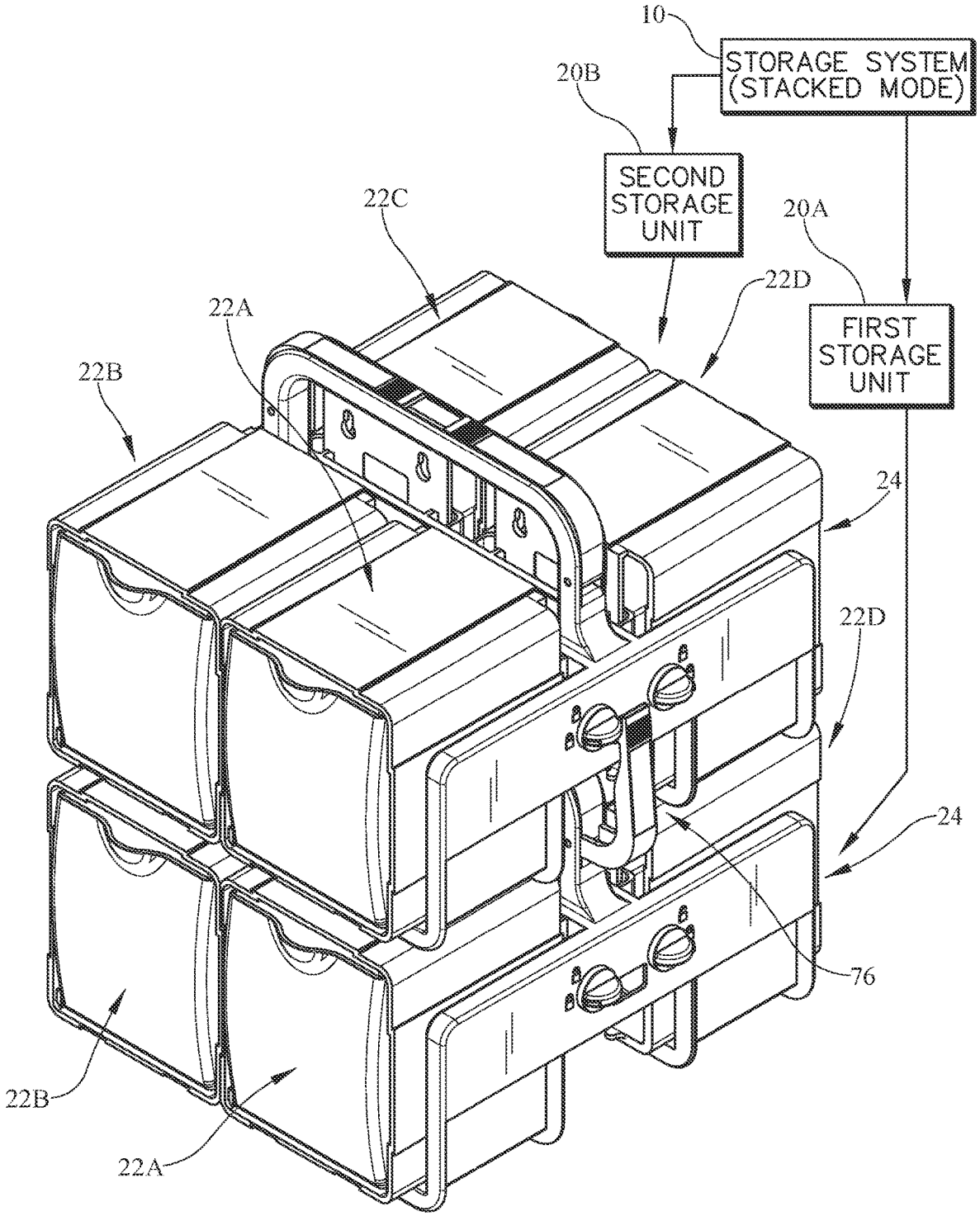
FIG. 12 is a view similar to FIG. 11 showing the first and second storage units vertically stacked on top of one another in a stacked mode in which the attachment arms of the first storage unit in the extended attachment position engage the container caddy of the second storage unit to secure the second storage unit with the first storage unit so that the storage system is transportable using a handle of the second storage unit.

Turning again to the customizable storage system 10, the customizable storage system 10 includes a plurality of storage units 20A, 20B, like the storage unit 20 in FIGS. 1-10. The storage units 20A, 20B are configured to be used separately when the storage units 20A, 20B are in an unstacked mode as shown in FIG. 11. However, the storage units 20A, 20B are also configured to be vertically stacked on top of one another in a stacked mode as shown in FIG. 12. In the stacked mode, the storage units 20A, 20B are secured to each other so that the carrying handle 58 of the second storage unit 20B serves as the handle 58 for the system 10 while the container support frame 56 of the first storage unit 20A serves as the base for the entire system 10. This permits a user to easily transport or carry the entire storage system 10.

To secure the second storage unit 20B on top of the first storage unit 20A, each of the storage units 20 includes attachment arms 76, 78 as shown in FIGS. 6, 11, and 12. Both attachment arms 76, 78 are pivotably coupled to a main handle body 58B of the carrying handle 58 of the container caddy 24. The first attachment arm 76 is pivotably coupled to the main handle body 58B of the carrying handle 58 near the first end of the container support frame 56 of the container caddy 24. The second attachment arm 78 is pivotably coupled to the carrying handle 58 near the second end of the container support frame 56 of the container caddy 24.

The attachment arms 76, 78 are configured to change between a retracted handle position and an extended attachment position as shown in FIG. 11. In the retracted handle position, the attachment arms 76, 78 are received in a groove 58G of the carrying handle 58 so that the attachment arms 76, 78 are flush with upper edges 58E of the carrying handle 58. In the extended attachment position, the attachment arms 76, 78 extend upwardly from the carrying handle 58 at a 90 degree angle relative to the carrying handle 58.

When transporting the respective storage unit 20, the attachment arms 76, 78 are located in the retracted handle position so that the attachment arms 76, 78 are flush with the upper edges 58E of the carrying handle 58. In this way, the handle 58 may be grasped to carry the container support frame 56 containing the plurality of storage containers 22A, 22B, 22C, 22D. To begin stacking the second storage unit 20B on top of the first storage unit 20A, the attachment arms 76, 78 of the first storage unit 20A are pivoted in a first direction from the retracted handle position to the extended attachment position as shown in FIGS. 11 and 12.

Each attachment arm 76, 78 is formed to include a projecting edge 76P, 78P as shown in FIGS. 6, 11, and 12. Each projecting edge 76P, 78P is configured to mate with an opening 75A formed in the corresponding side panel 74A, 74B of the container support frame 56 as shown in FIG. 12. When the second storage unit 20B is vertically stacked on top of the first storage unit 20A, the projecting edges 76P, 78P on each attachment arm 76, 78 of the first support unit 20A extends into the corresponding opening 75A on each side of the container support frame 56 of the second storage unit 20B. This secures the second storage unit 20B with the first storage unit 20A in the stacked mode such that the storage system 10 is transportable using the handle 58 of the second, or upper storage unit 20B while the container support frame 56 of the first, or lower storage unit 20A serves as the base of the entire system 10.

Compared to other customizable storage systems, the storage system 10 allows the storage units 20 to be stacked without blocking access to the storage containers 22A, 22B, 22C, 22D. Other storage systems include containers with top opening lids that get covered when another container is stacked on top thereof. To access the containers underneath, the upper containers need to be removed and/or the system may need to be disassembled.

However, the storage system 10 of the present application is arranged such that the storage units 20A, 20B do not need to be disassembled to access the corresponding containers 22A, 22B, 22C, 22D. With the first and second storage units 20A, 20B in the stacked mode, each of the tilt bins 32 is still able to tilt between the retracted storage position and the extended use position when the corresponding container rotary locks 26, 28 are in the unlocked mode. In this way, the storage space 33 of each tilt bin 32 can be access regardless of whether the first and second storage units 20A, 20B are in the stacked mode.

In the illustrative embodiment, the storage system 10 includes two storage units 20A, 20B. However, in other embodiments, more than two storage units 20A, 20B may be included in the storage system 10. In some embodiments, three storage units 20 may be stacked in the stacked mode. In other embodiments, more than three storage units 20 may be stacked in the stacked mode.

Figure 13:
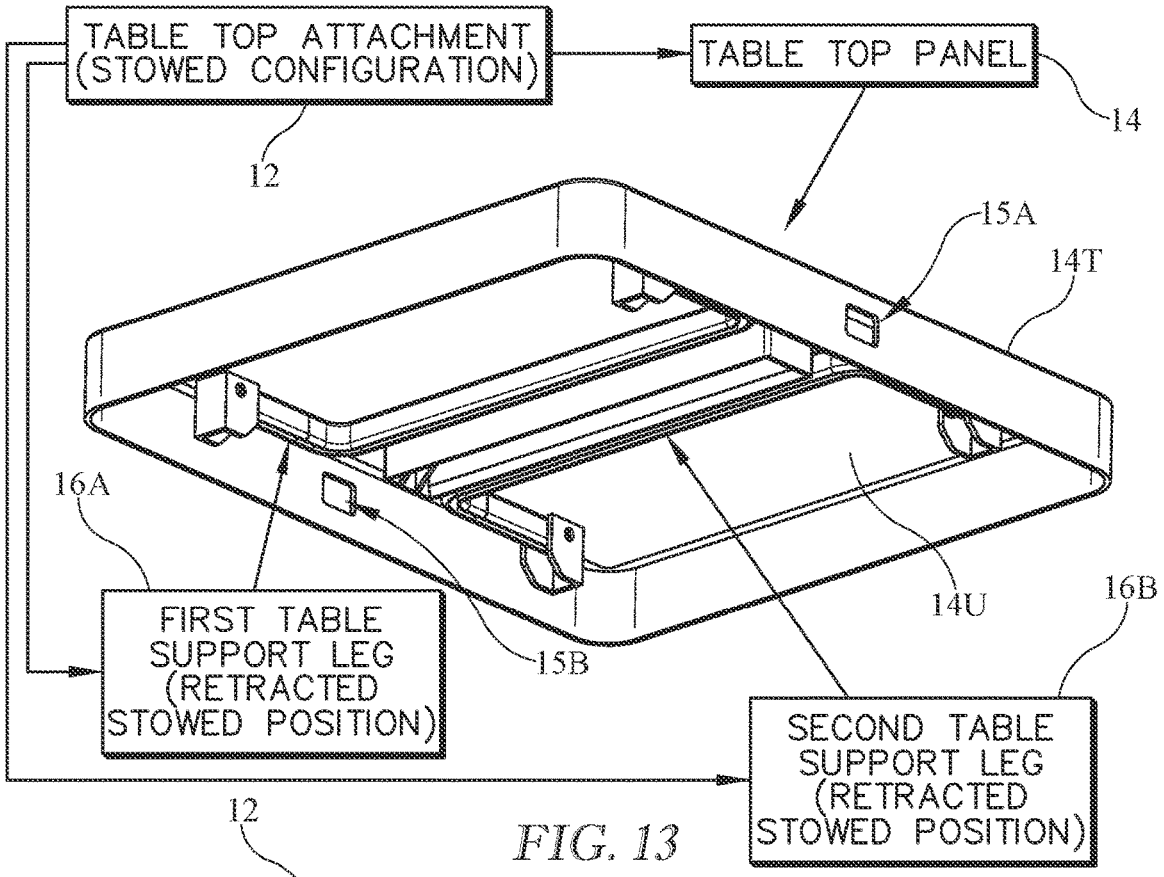
FIG. 13 is a perspective view of a table top attachment included in the customizable storage system configured to be vertically stacked on top of the storage unit like as shown in FIGS. 15 and 16.
Figure 14:
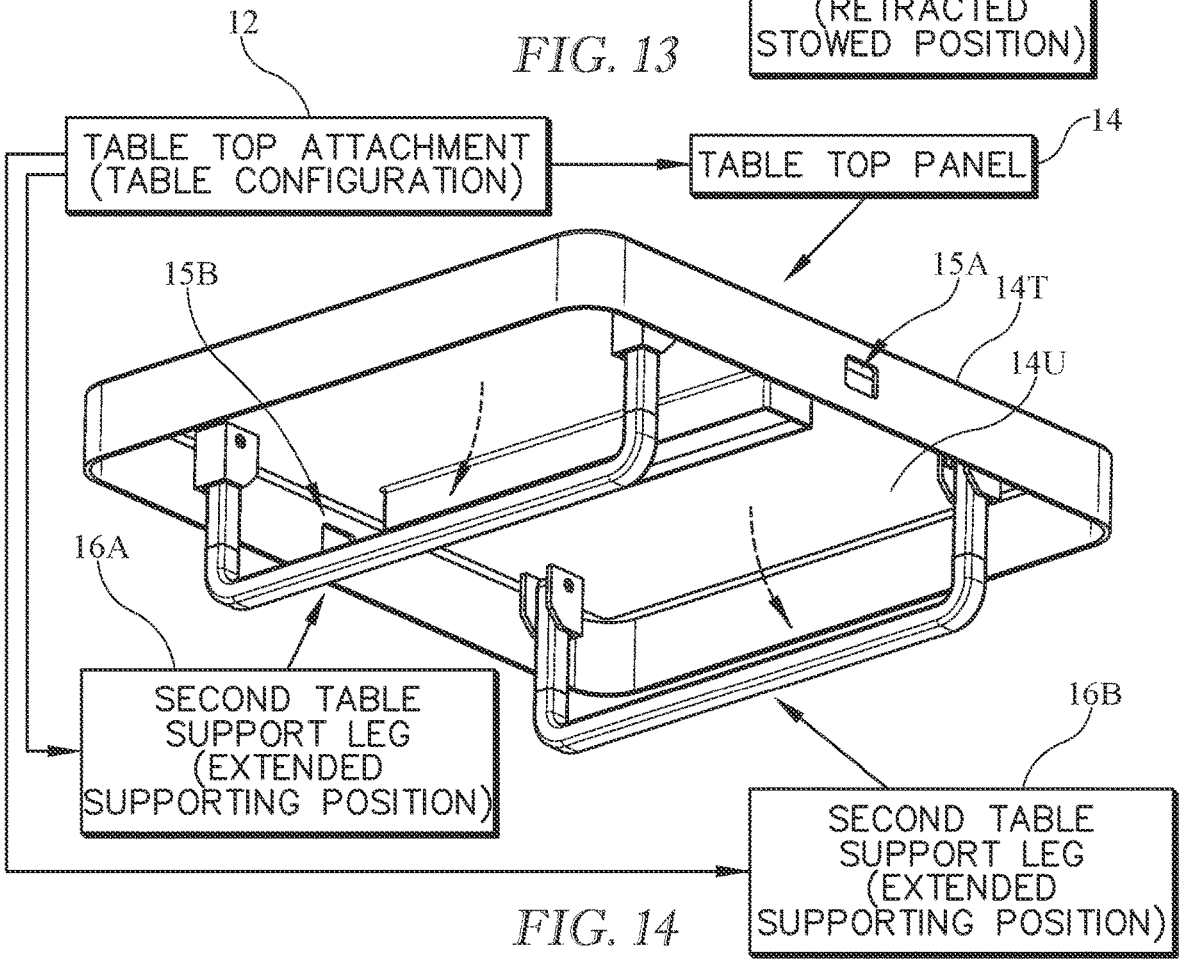
FIG. 14 is a view similar to FIG. 13 showing the table top attachment includes a table top panel and table support legs pivotally coupled to the table top panel to change between a retracted stowed position as shown in FIG. 13 so that the table top is in a stowed configuration and an extended supporting position as shown in FIG. 15 so that the table top is in a table configuration.
Figure 15:
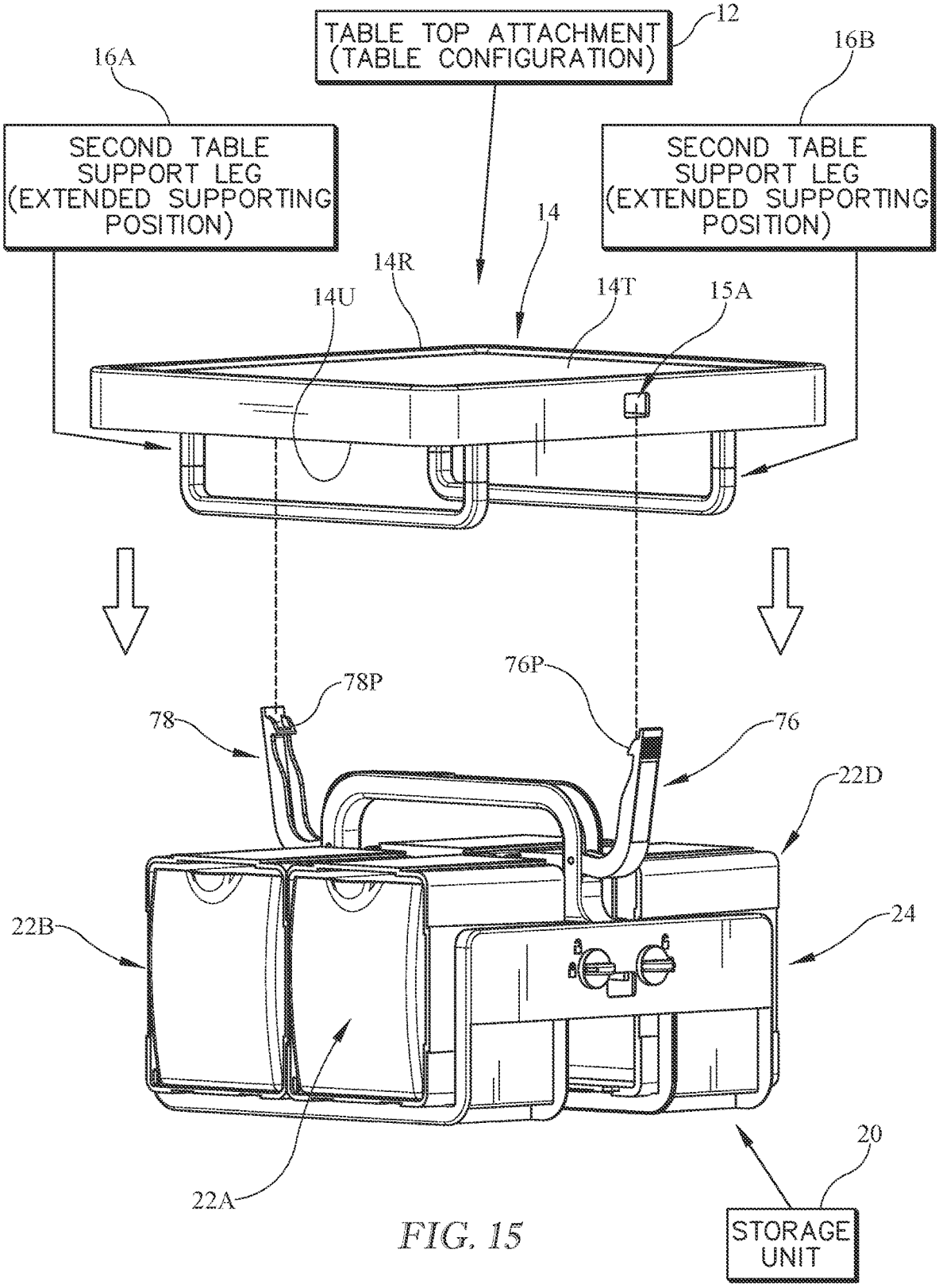
FIG. 15 is a perspective view of the table top attachment in the table orientation the about to vertically stacked on top of the storage unit so that the table top attachment is in a table mode like as shown in FIG. 16.
Figure 16:
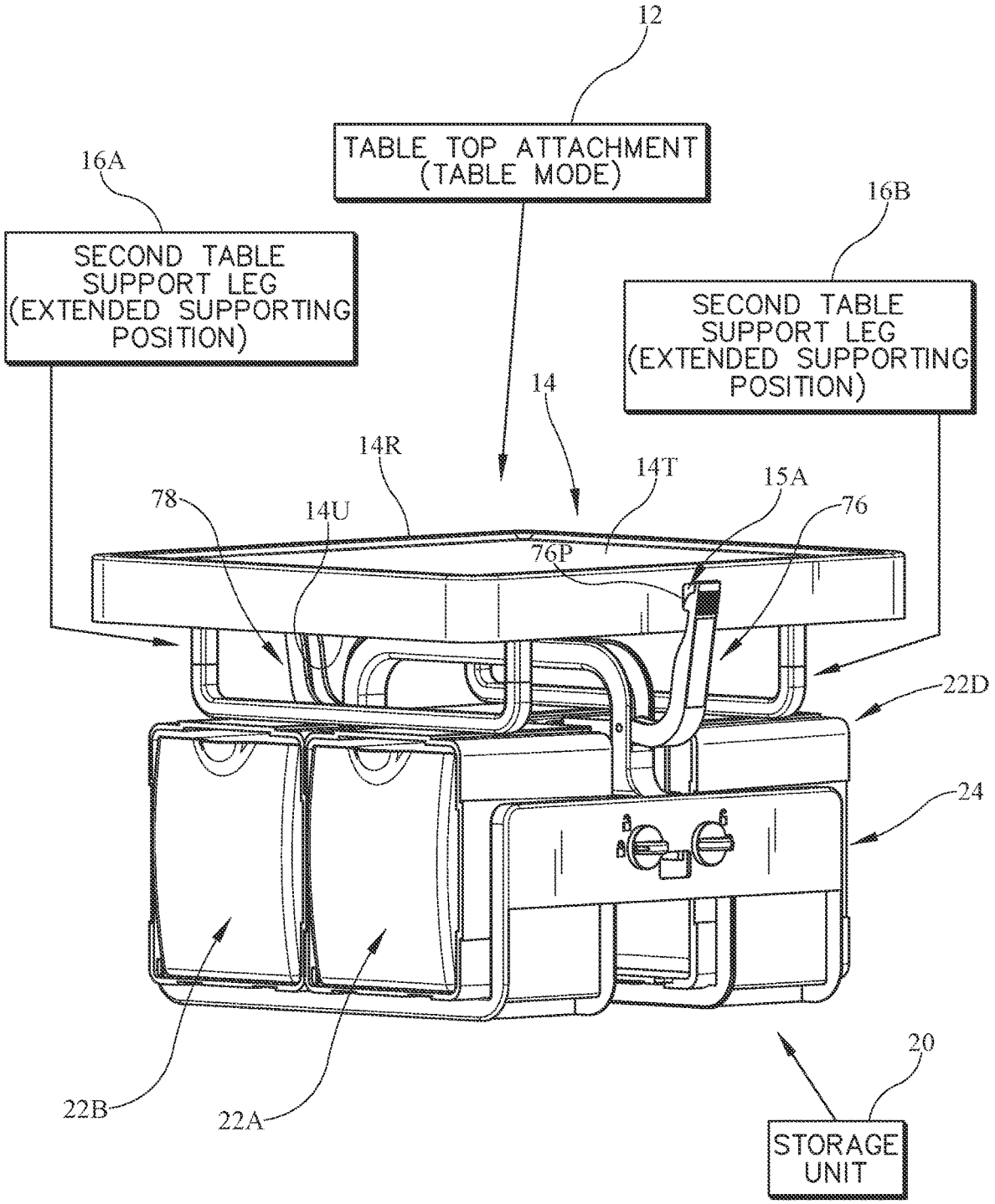
FIG. 16 is a view similar to FIG. 15 showing the table top attachment in a table mode in which the attachment arms of the storage unit in the extended attachment position engage the table top panel to secure the table top attachment with the storage unit so that the table top attachment may be used as a table to support different objects on top of the storage unit.

In the illustrative embodiment, the customizable storage system 10 further includes a table top attachment 12 as shown in FIGS. 13-16. The table top attachment 12 is configured to be vertically stacked on top of one of the storage units 20 as shown in FIGS. 15 and 16. The table top attachment 12 includes a table top panel 14 and table support legs 16A, 16B. Each of the table support legs 16A, 16B pivotally coupled to the table top panel 14 to change between a retracted stowed position as shown in FIG. 13 and an extended supporting position as shown in FIGS. 14 and 15.

When the table support legs 16A, 16B are in the retracted stowed position, the table top attachment 12 is in a stowed configuration as shown in FIG. 13. In the retracted stowed position, the table support legs 16A, 16B confront the table top panel 14 so that the table support legs 16A, 16B are hidden under the table top panel 14.

When the table support legs 16A, 16B are in the extended supporting position, the table top attachment 12 is in a table configuration as shown in FIGS. 14 and 15. In the extended supporting position, the table support legs 16A, 16B extend perpendicular to the table top panel 14. In this way, the table support legs 16A, 16B will engage the storage containers 22A, 22B, 22C, 22D of the storage unit 20 that table top attachment 12 is to be stacked on.

The table support legs 16A, 16B are coupled to an underside 14U of the table top panel 14 so that when the table top attachment 12 is stacked on top of the storage unit 20, the topside 14T of the table top panel 14 provides a support surface. The support surface provides a level, planar surface that may be used to support different objects on top of the storage unit 20. In the illustrative embodiment, the table top panel 14 is formed to include a rim 14R around the perimeter edge of the table top panel 14 to block objects from rolling off the table top panel 14.

To secure the table top attachment 12 on top of the storage unit 20, the attachment arms 76, 78 of the storage unit 20 are located in the extended attachment position as shown in FIGS. 15 and 16. The table top attachment 12 in the table orientation is then lowered so that the table support legs 16A, 16B in the extended supporting position engage the top wall 34T of the container shell 34 and the projecting edge 76P, 78P mates with an opening 15A, 15B formed in opposite sides of the table top panel 14 as shown in FIGS. 15 and 16. This secures the table top attachment 12 with the storage unit 20 in a table mode such that the topside 14T of the table top panel 14 provides the support surface.

Figure 17:
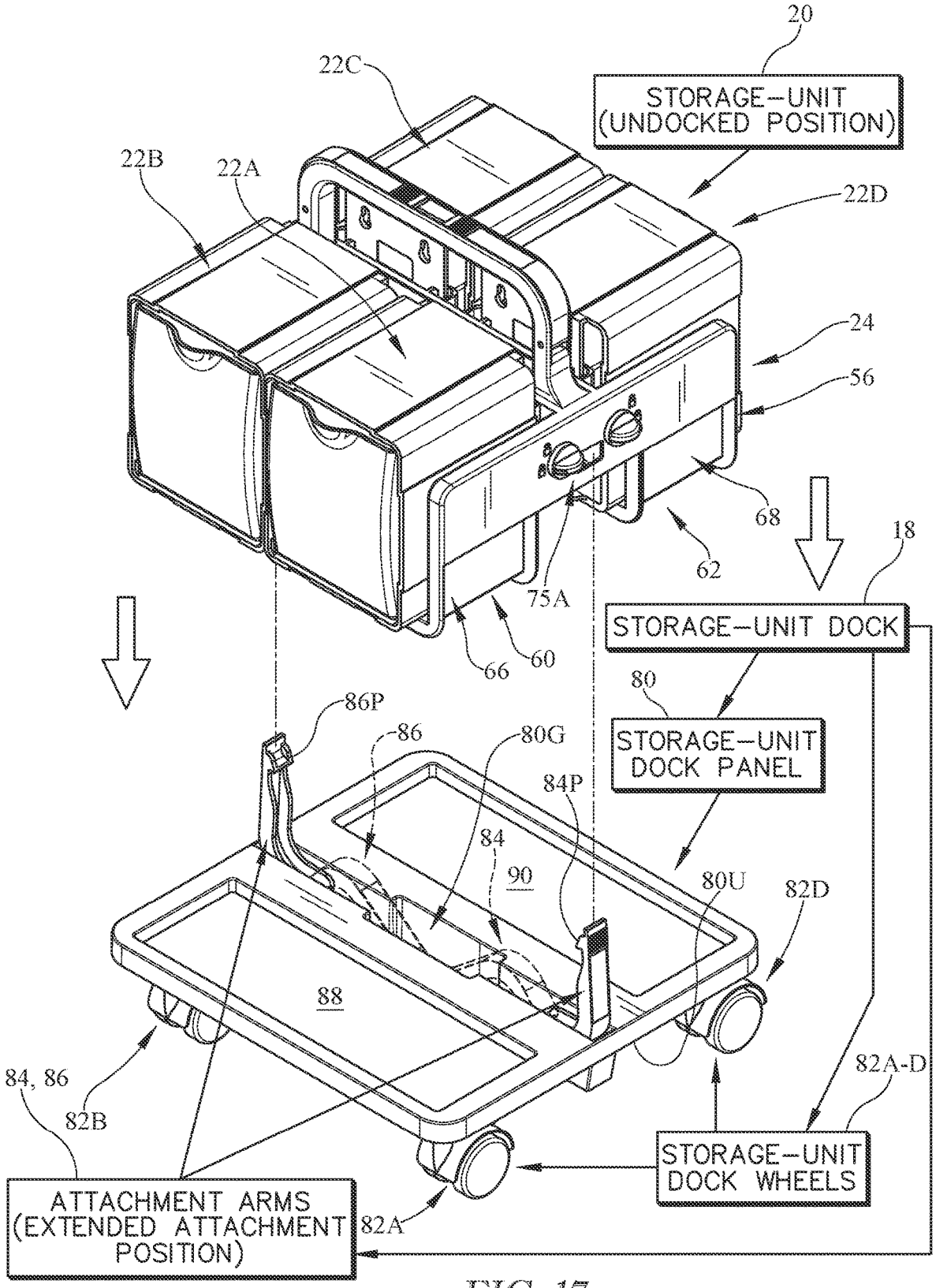
FIG. 17 is a perspective view of the storage unit in an undocked position about to vertically stacked on top of a storage-unit dock included in the customizable storage system so that the storage-unit dock is in a transport mode like as shown in FIG. 18.
Figure 18:
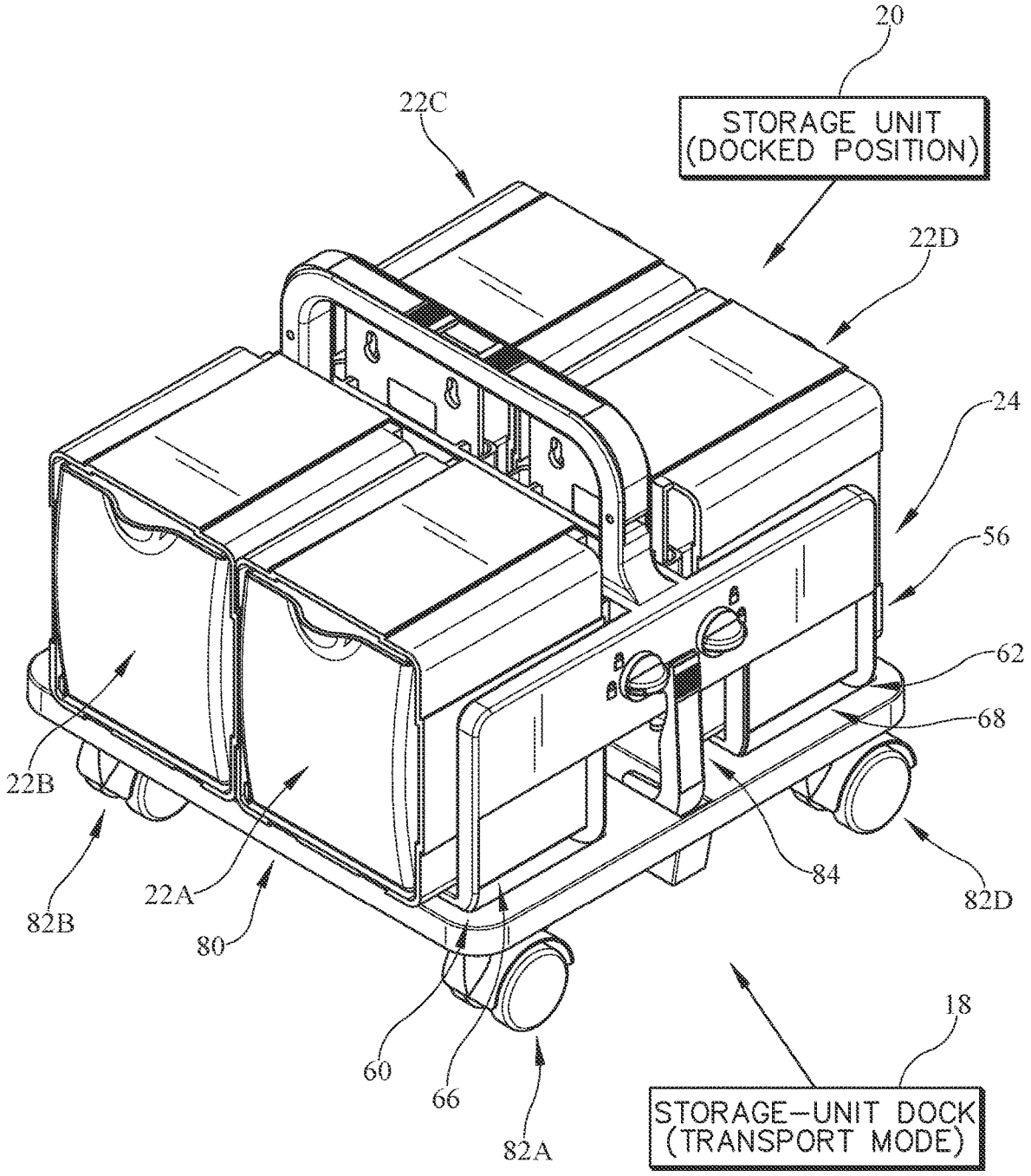
FIG. 18 is a view similar to FIG. 17 showing the storage unit is in a docked position in which the storage unit is vertically stacked on top of the storage-unit dock in the transport mode in which attachment arms of the storage-unit dock in the extended attachment position engage the container caddy of the storage unit to secure the storage unit with the storage-unit dock.

In the illustrative embodiment, the customizable storage system 10 further includes a moveable storage-unit dock 18 as shown in FIGS. 17 and 18. One of the storage units 20 is configured to be vertically stacked on top of the moveable storage-unit dock 18 as shown in FIGS. 17 and 18.

The storage-unit dock 18 includes a storage-unit dock panel 80 and wheels 82A, 82B, 82D as shown in FIGS. 17 and 18. The storage-unit dock panel 80 is formed to include container dock receiving space 88, 90 that are configured to receive the corresponding container dock 60, 62 of the storage unit 20. The wheels 82A, 82B, 82D are coupled to an underside 80U of the storage-unit dock panel 80 to allow the storage-unit dock 80 to be rolled along a ground surface.

When the storage unit 20 is vertically stacked on the storage-unit dock panel 80 in a docked position, the first container dock receiving space 88 receives the bottom dock panel 66 of the first container dock 60 and the second container dock receiving space 90 receives the bottom dock panel 68 of the second container dock as shown in FIG. 18. The storage unit 20 is dropped in so that the bottom dock panel 66 of the first container dock 60 extends into the first container dock receiving space 88 and the bottom dock panel 68 of the second container dock extends into the second container dock receiving space 90. This helps retain the storage unit 20 to the storage-unit dock 18 in the docked position on the storage-unit dock 18.

To further secure the storage unit 20 to the storage-unit dock 18, the storage-unit dock 18 further includes attachment arms 84, 86 as shown in FIGS. 17 and 18. The first attachment arm 84 is pivotably coupled to the storage-unit dock panel 80 of the storage-unit dock near a first end of the storage unit dock. The second attachment arm 86 is pivotably coupled to the storage-unit dock panel 80 of the storage-unit dock near a second end of the storage unit dock.

The attachment arms 84, 86 are similar to the attachment arms 76, 78 of the storage unit 20 in that the attachment arms 84, 86 are pivotably coupled to the storage-unit dock 80 to change between a retracted handle position and an extended attachment position as shown in FIG. 17. In the retracted handle position, the free end of each attachment arms 84, 86 is received in a groove 80G of the storage-dock panel 80. In the extended attachment position, the attachment arms 84, 86 extend upwardly from the storage-unit dock panel 80 at a 90 degree angle relative to the storage-unit dock panel 80.

Each attachment arm 84, 86 is formed to include a projecting edge 84P, 86P as shown in FIG. 17. Each projecting edge 84P, 86P is configured to mate with an opening 75A formed in the container support frame 56 as shown in FIGS. 17 and 18.

When the storage unit 20 is vertically stacked on top of the storage-unit dock 18 in the docked position, the projecting edges 84P, 86P on each attachment arm 84, 86 of the storage-unit dock 18 extends into the corresponding opening 75A on each side of the container support frame 56 of the storage unit 20. This secures the storage unit 20 with the storage-unit dock 18 in a transport mode such that the storage unit 20 is fixed for movement with the storage-unit dock 18 as the storage-unit dock 18 is wheeled along a ground surface.

Figure 19:
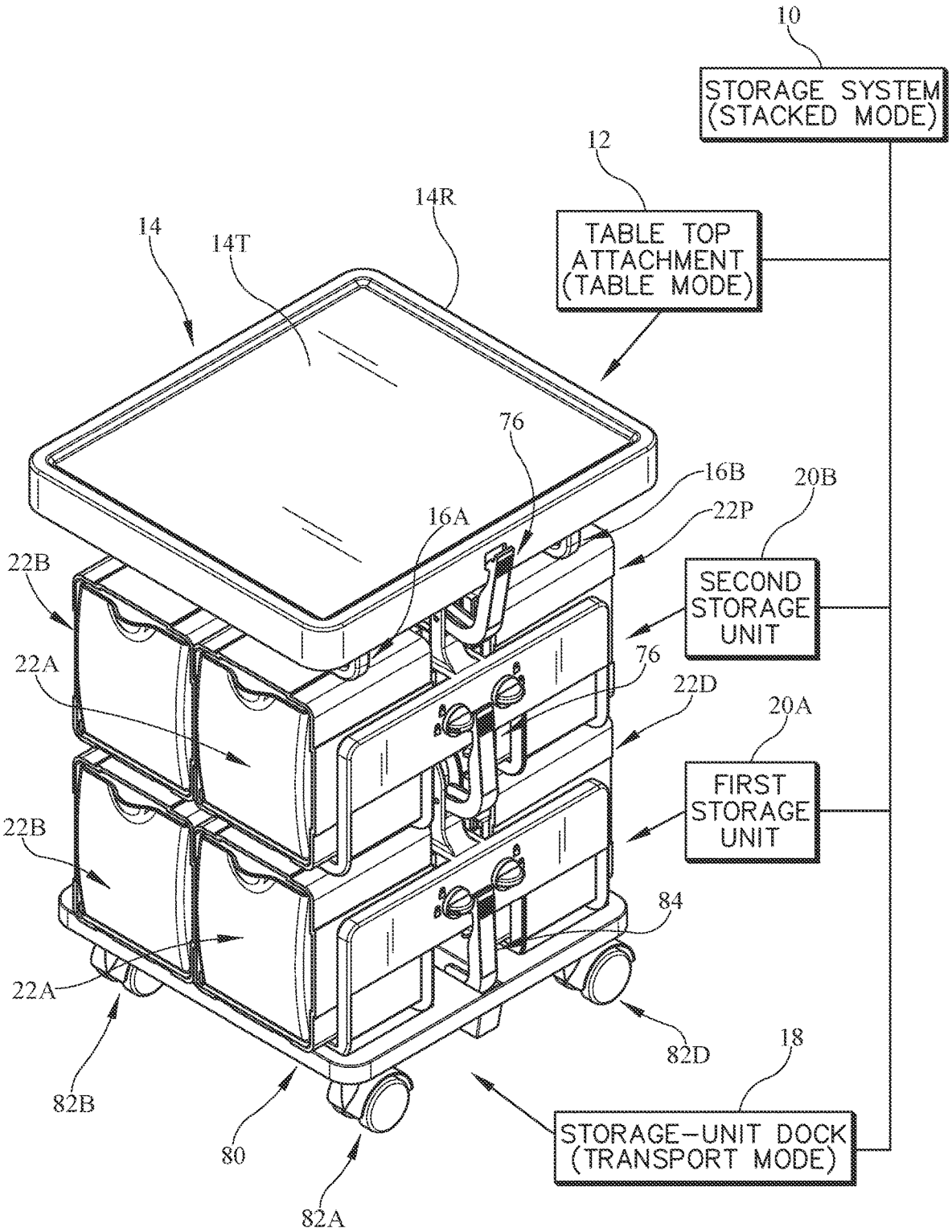
FIG. 19 is a perspective view of the fully assembled customizable storage system including the first and second storage units, the table top attachment, and the storage-unit dock showing the first and second storage units are in the stacked mode, the table top attachment is in the table mode, and the storage-unit dock is in the transport mode.
Figure 20:
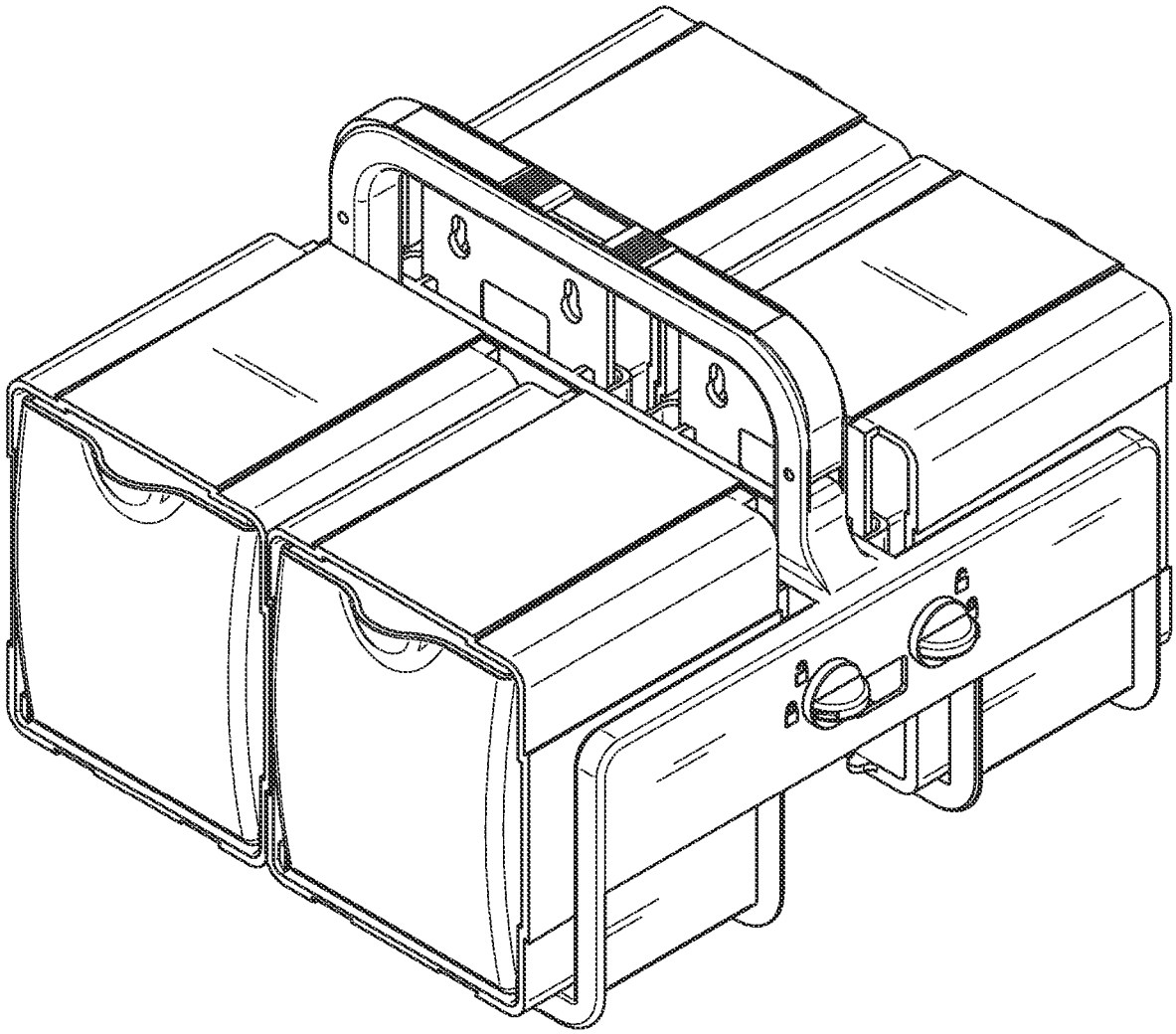
FIG. 20 is a perspective view of a storage system.
Figure 21:
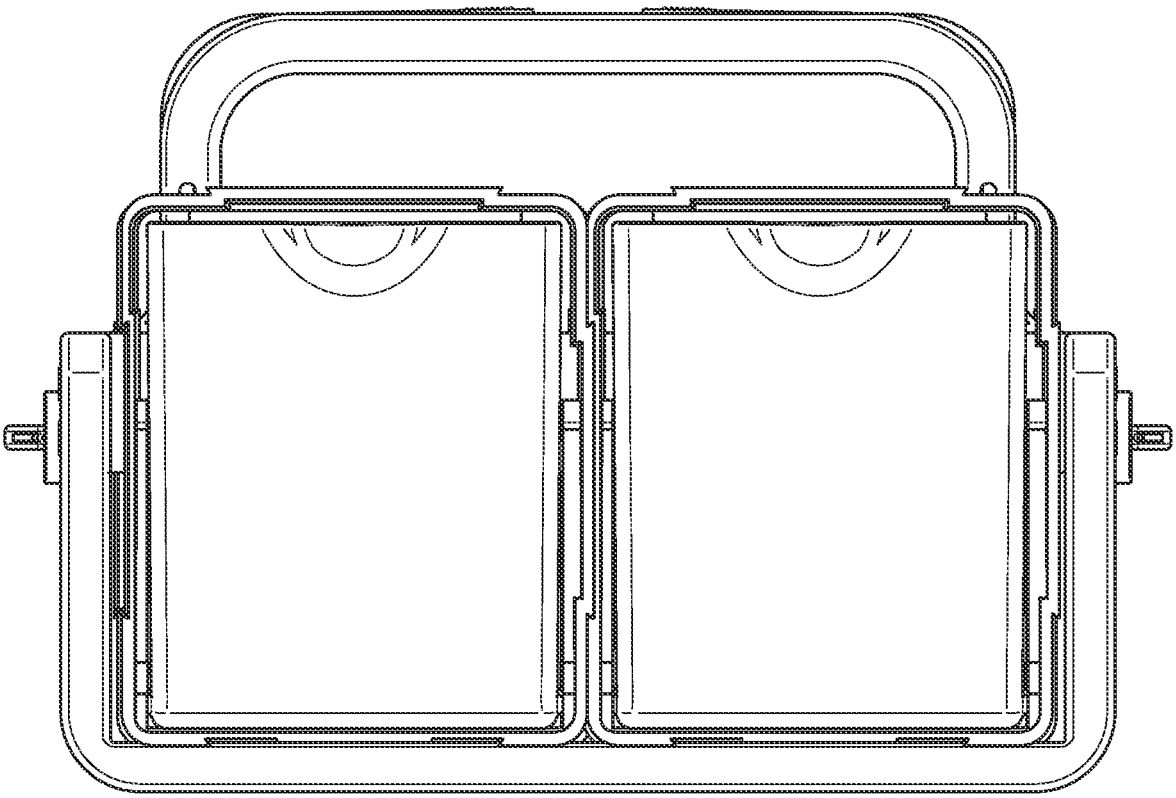
FIG. 21 is a front view of the storage system of FIG. 20, the rear view being a mirror image.
Figure 22:
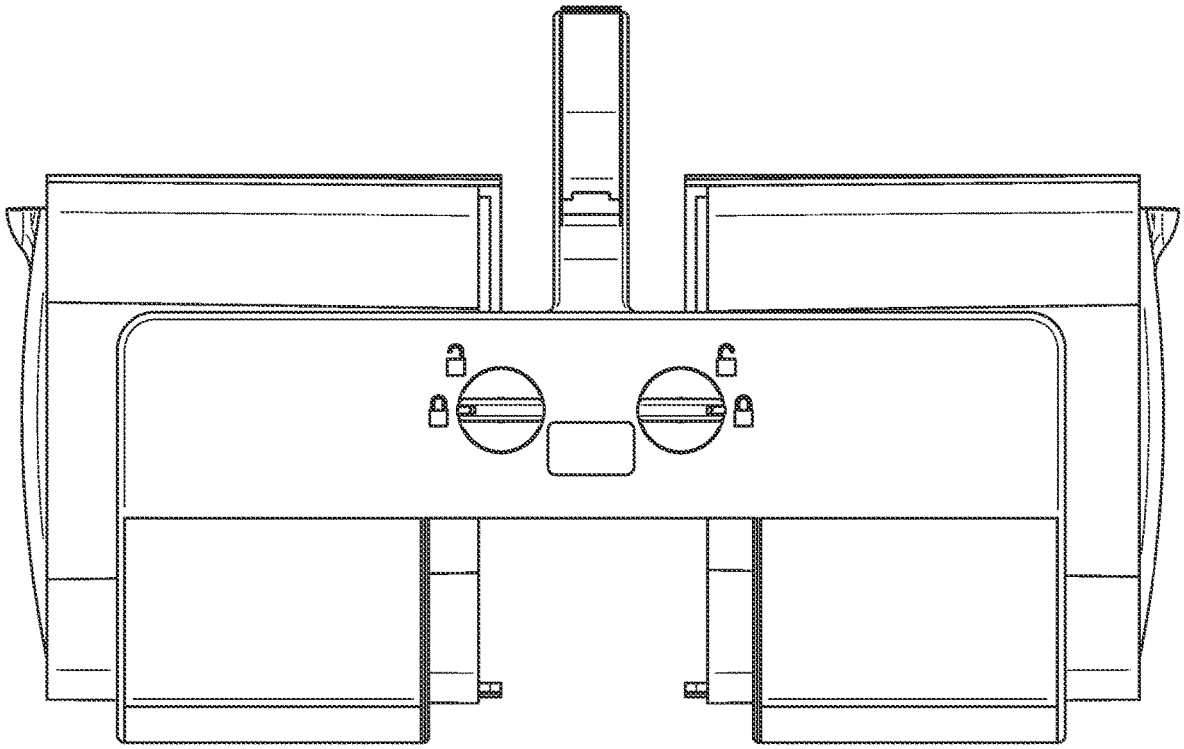
FIG. 22 is a left side view of the storage system of FIG. 20, the right side being a mirror image.
Figure 23:
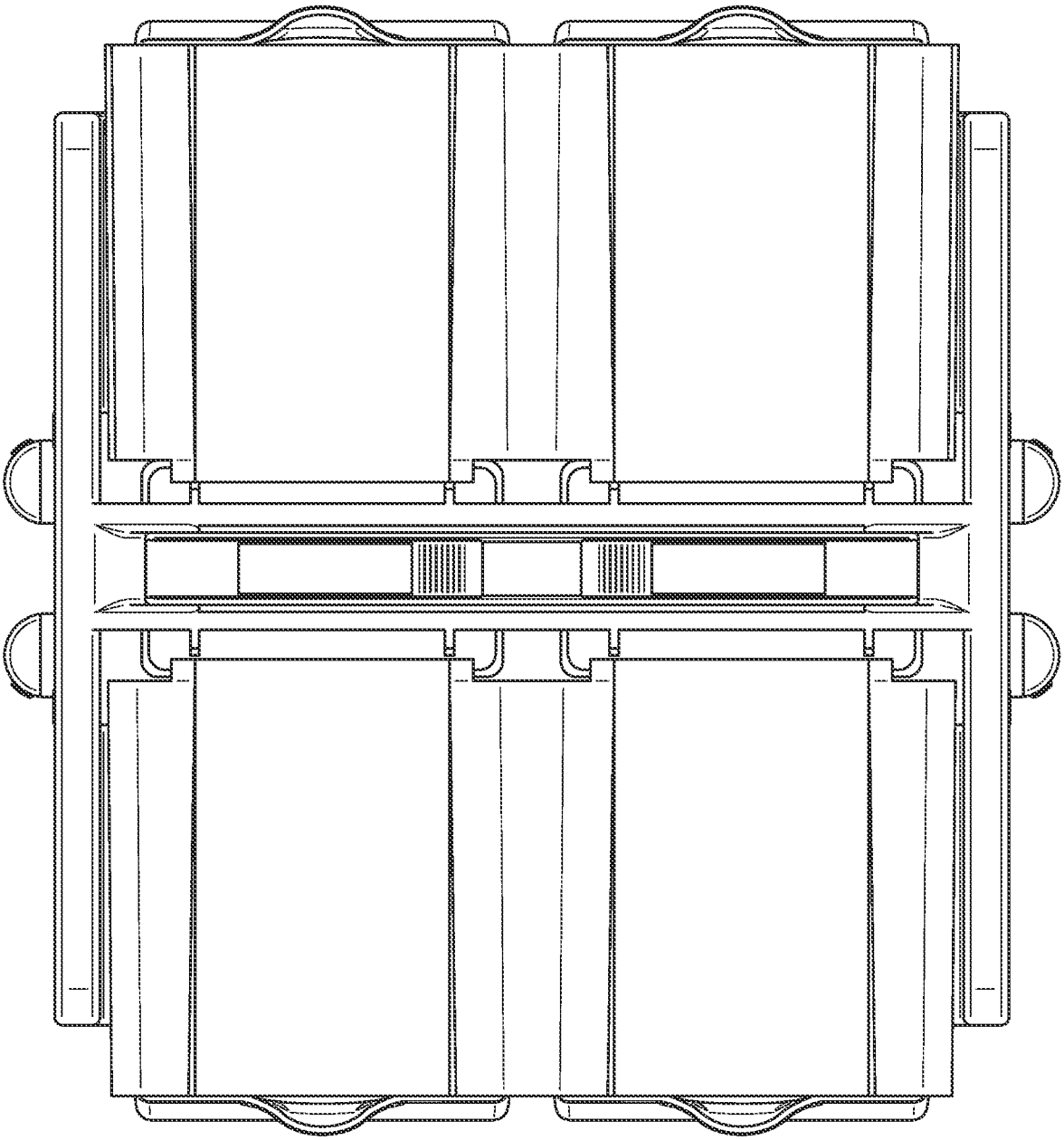
FIG. 23 is a top view of the storage system of FIG. 20.
Figure 24:
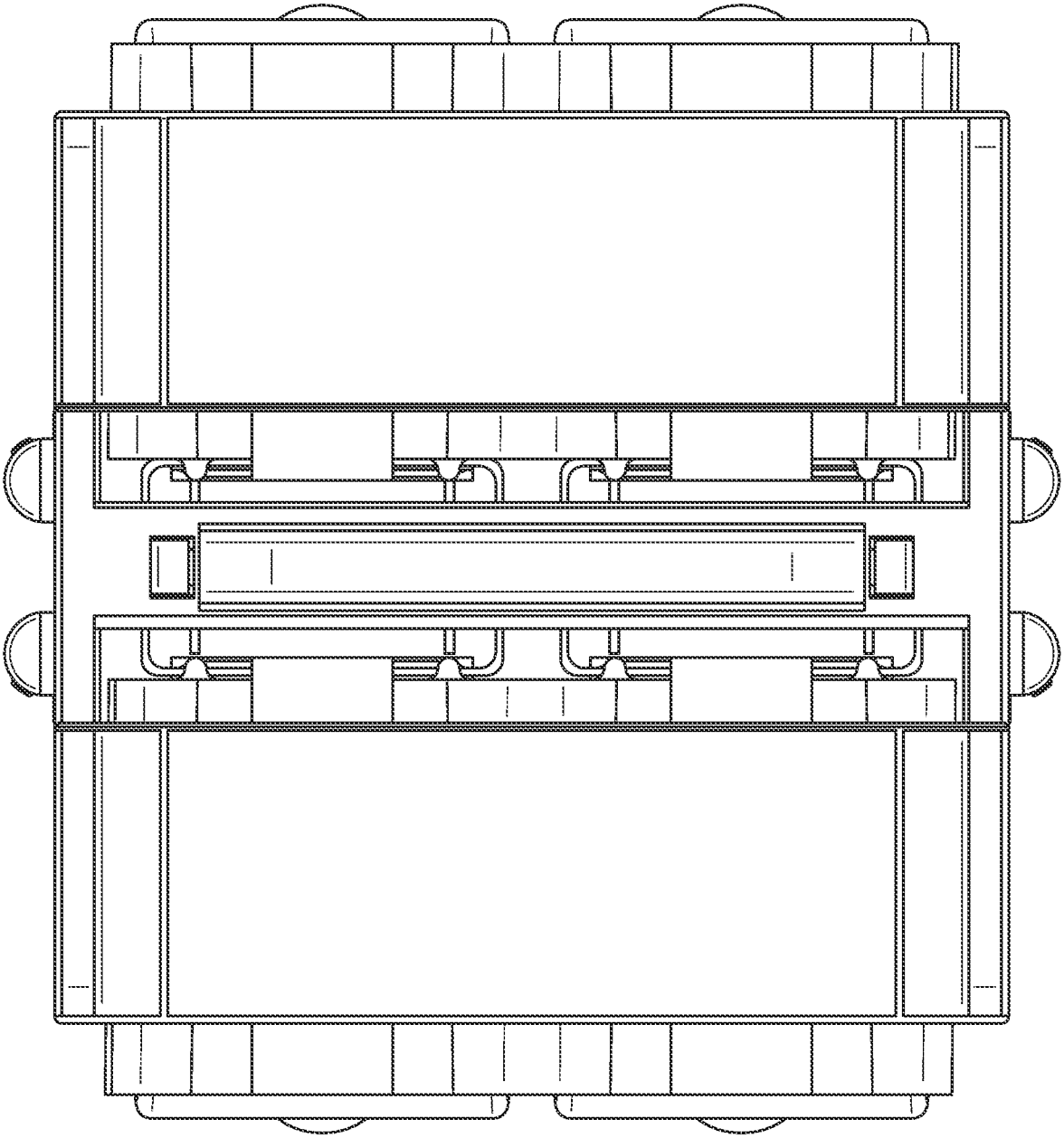
FIG. 24 is a bottom view of the storage system of FIG. 20.
Figure 25:
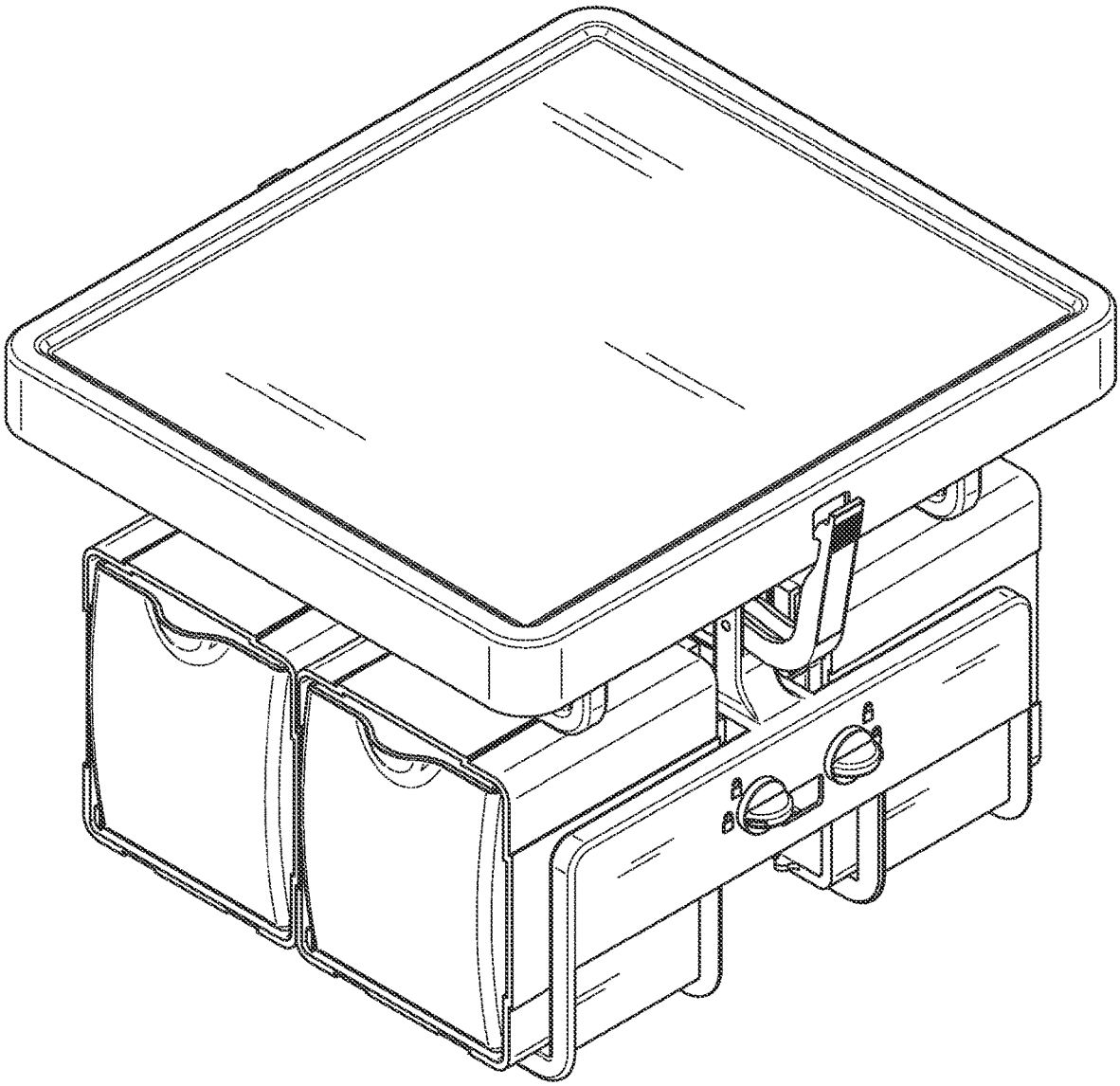
FIG. 25 is a perspective view of a storage system.
Figure 26:
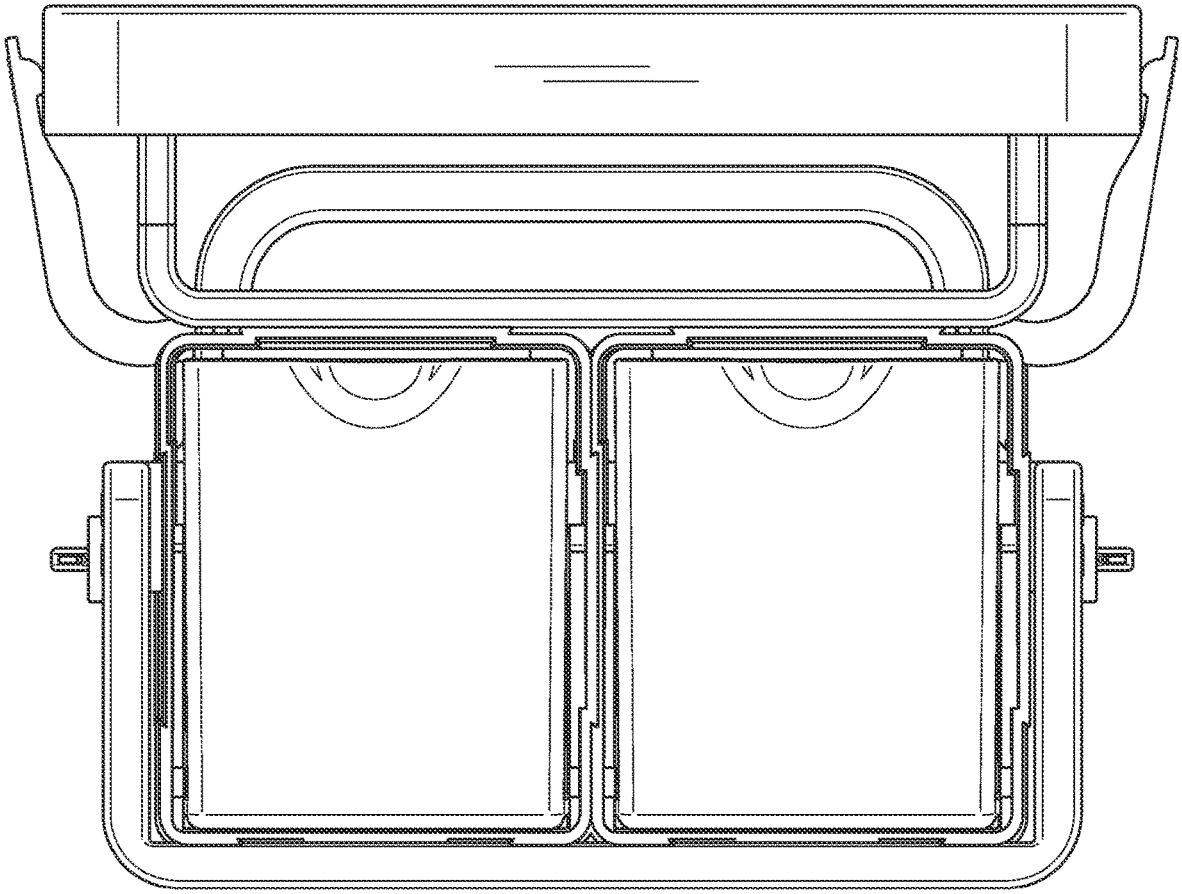
FIG. 26 is a front view of the storage system of FIG. 25, the rear view being a mirror image.
Figure 27:
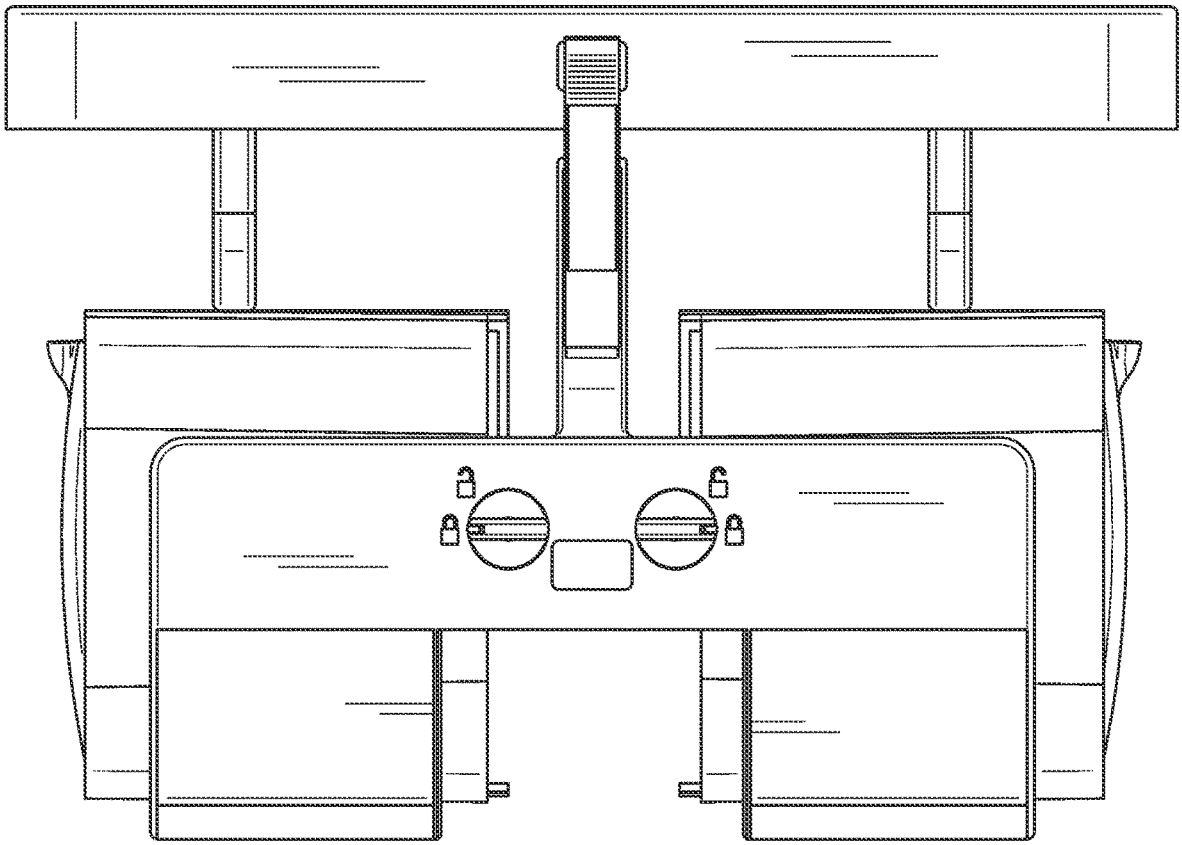
FIG. 27 is a left side view of the storage system of FIG. 25, the right side being a mirror image.
Figure 28:
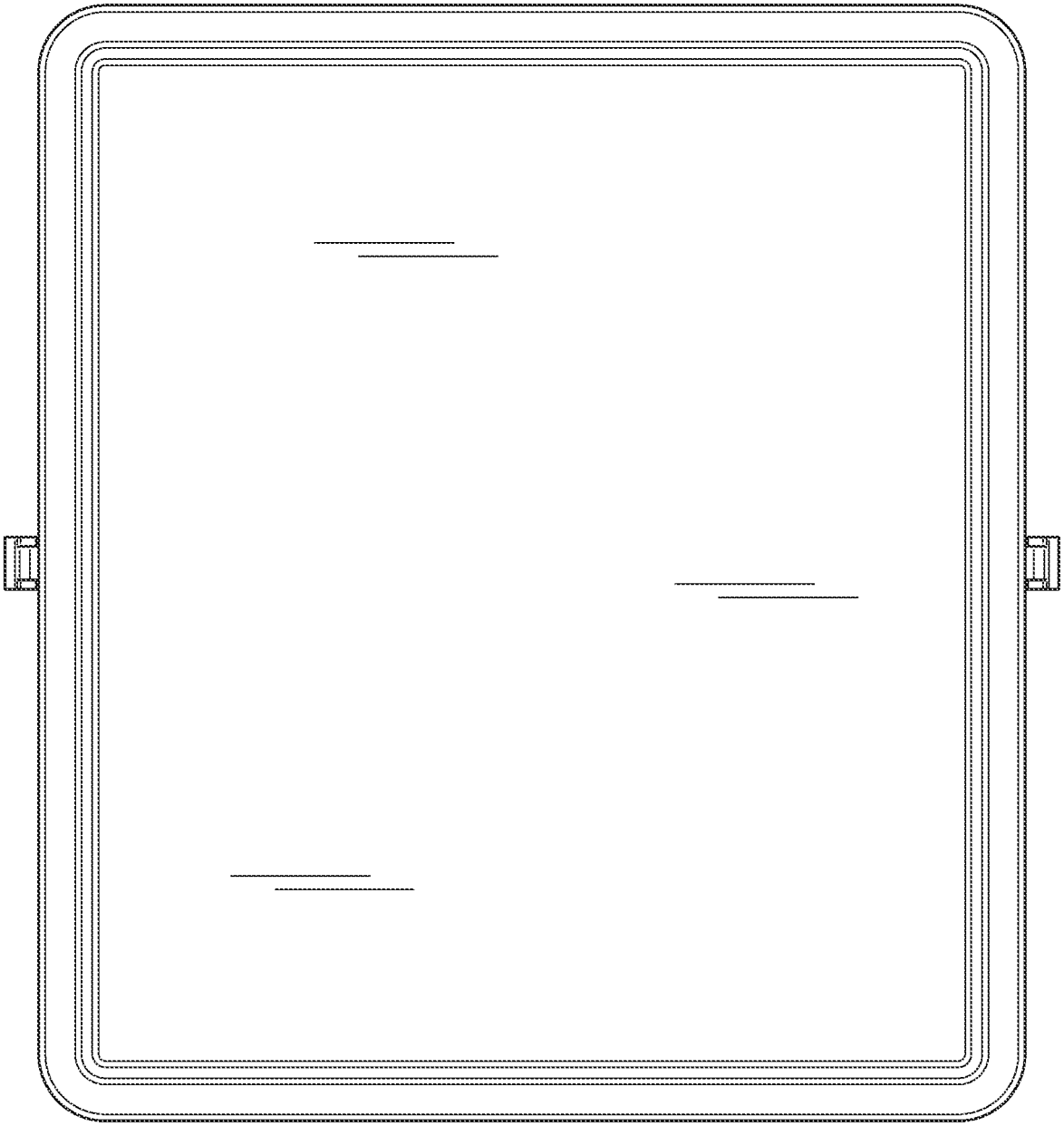
FIG. 28 is a top view of the storage system of FIG. 25.
Figure 29:
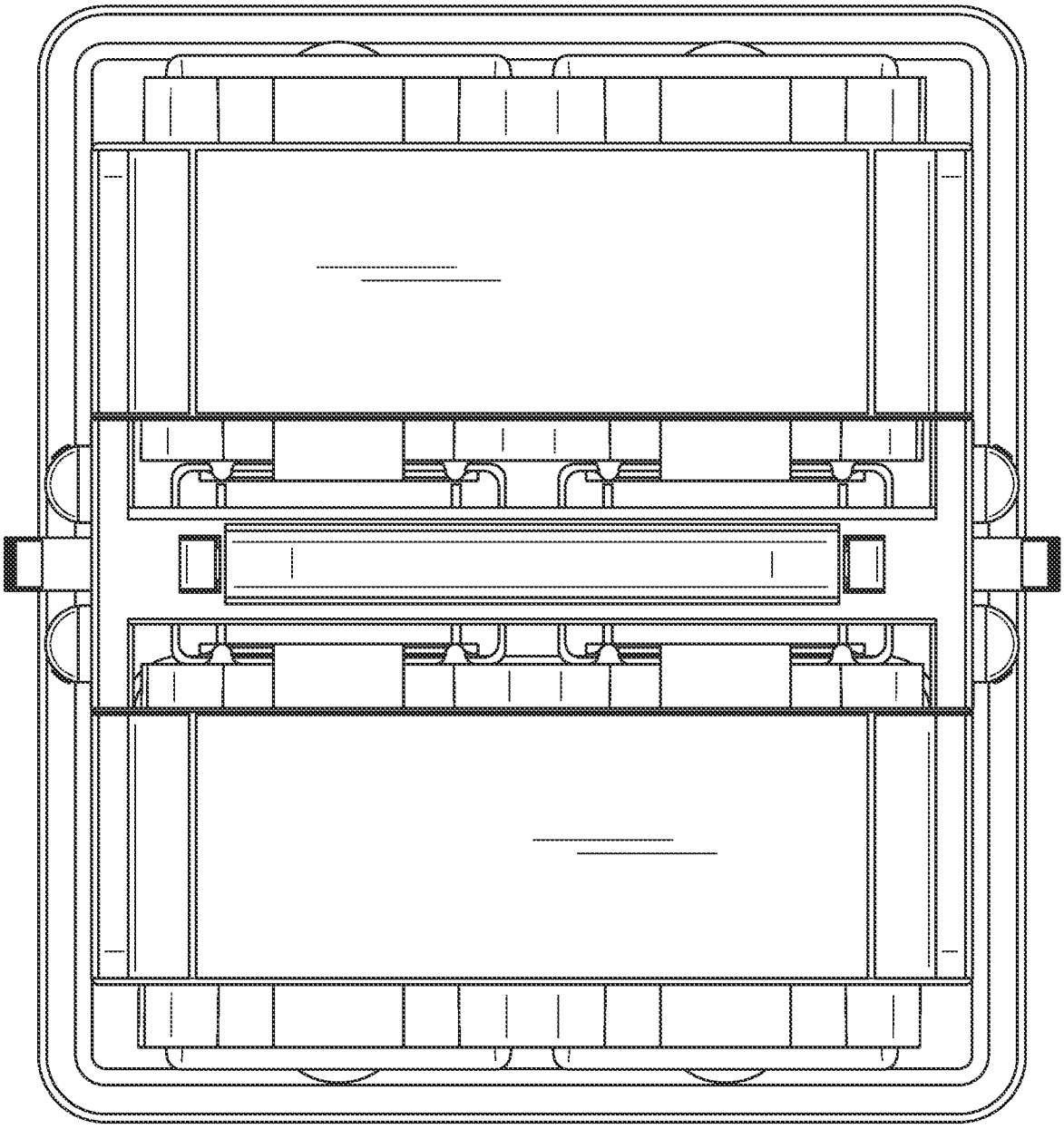
FIG. 29 is a bottom view of the storage system of FIG. 25.
Figure 30:
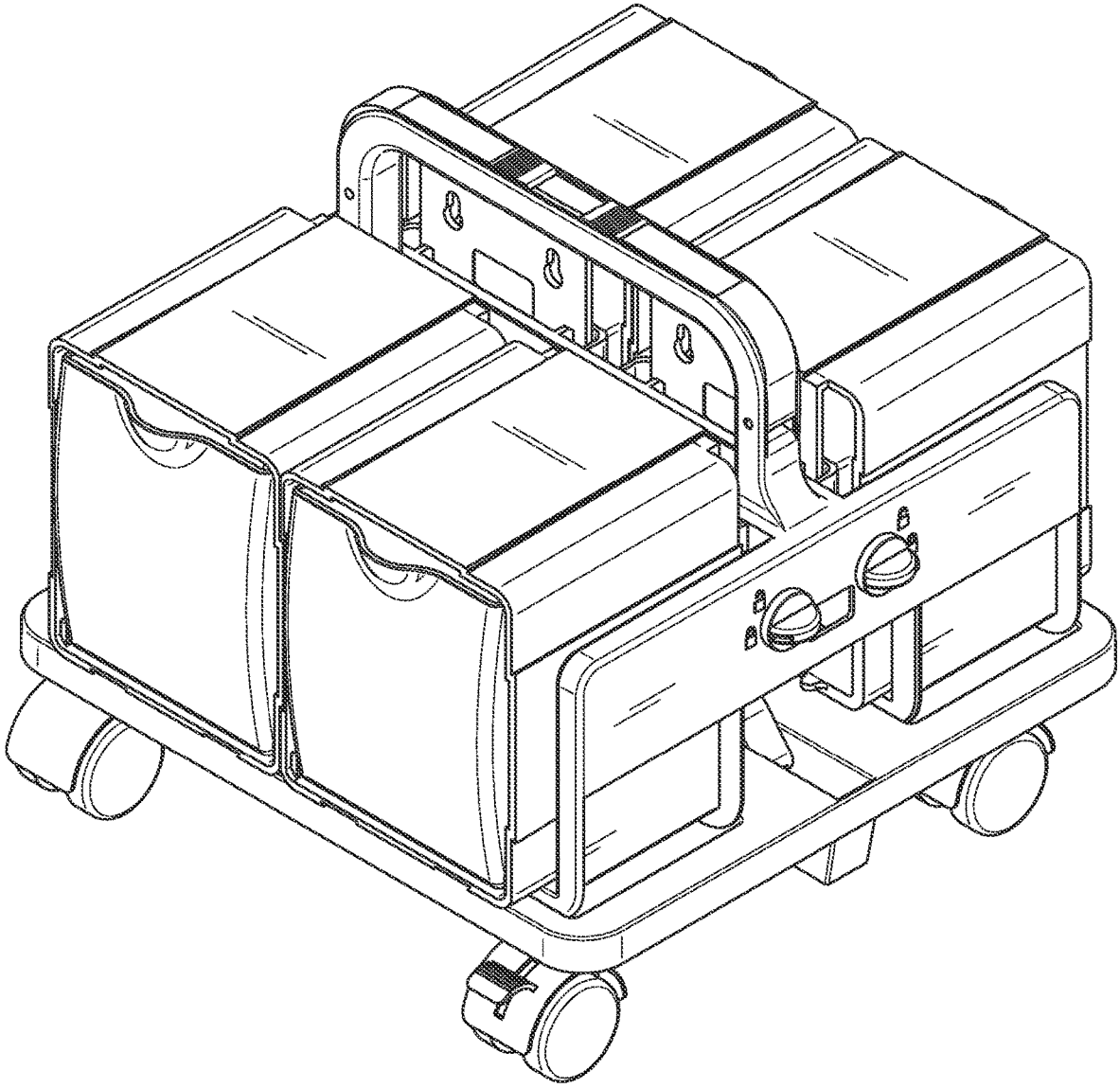
FIG. 30 is a perspective view of a storage system.
Figure 31:
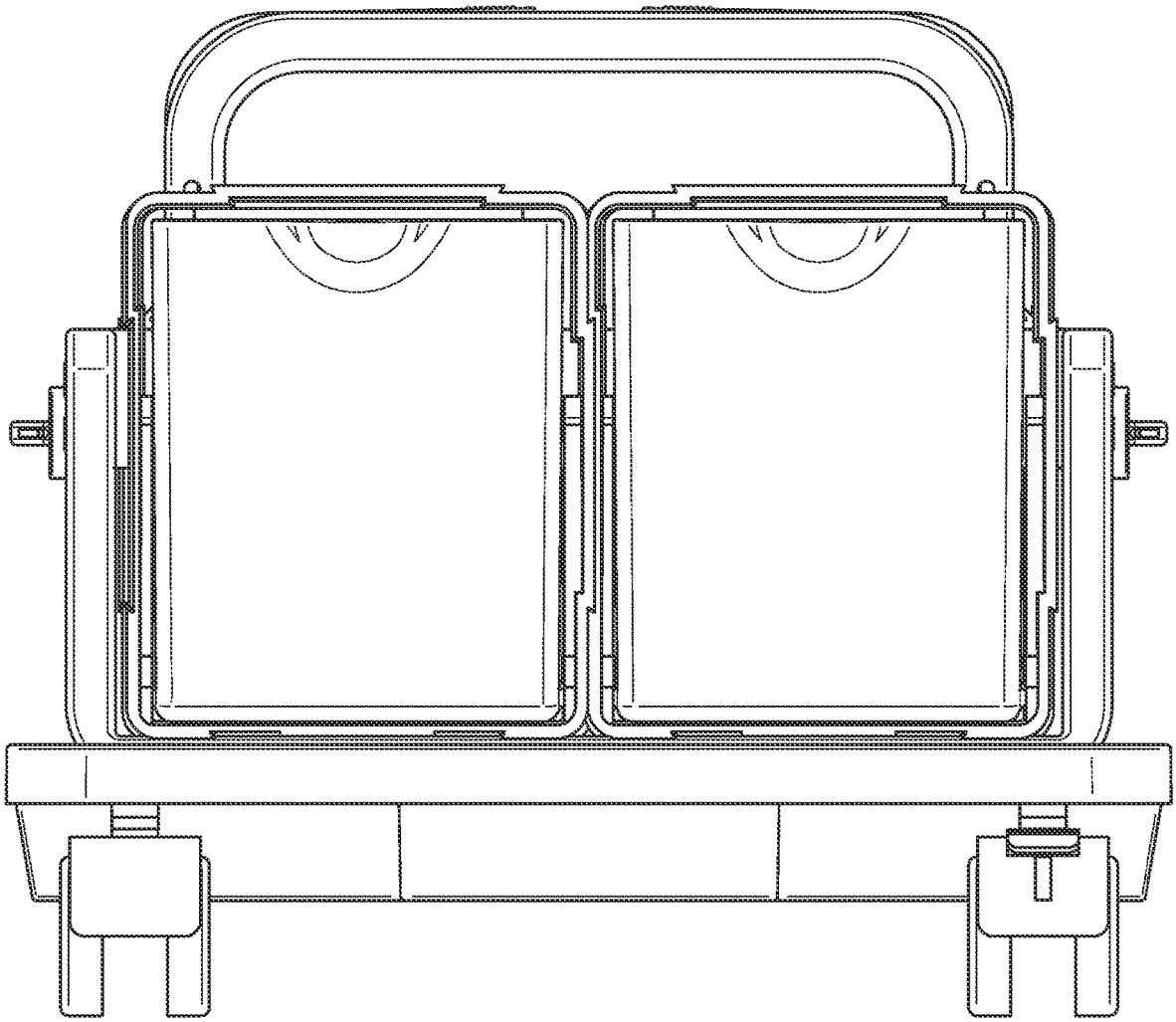
FIG. 31 is a front view of the storage system of FIG. 30, the rear view being a mirror image.
Figure 32:
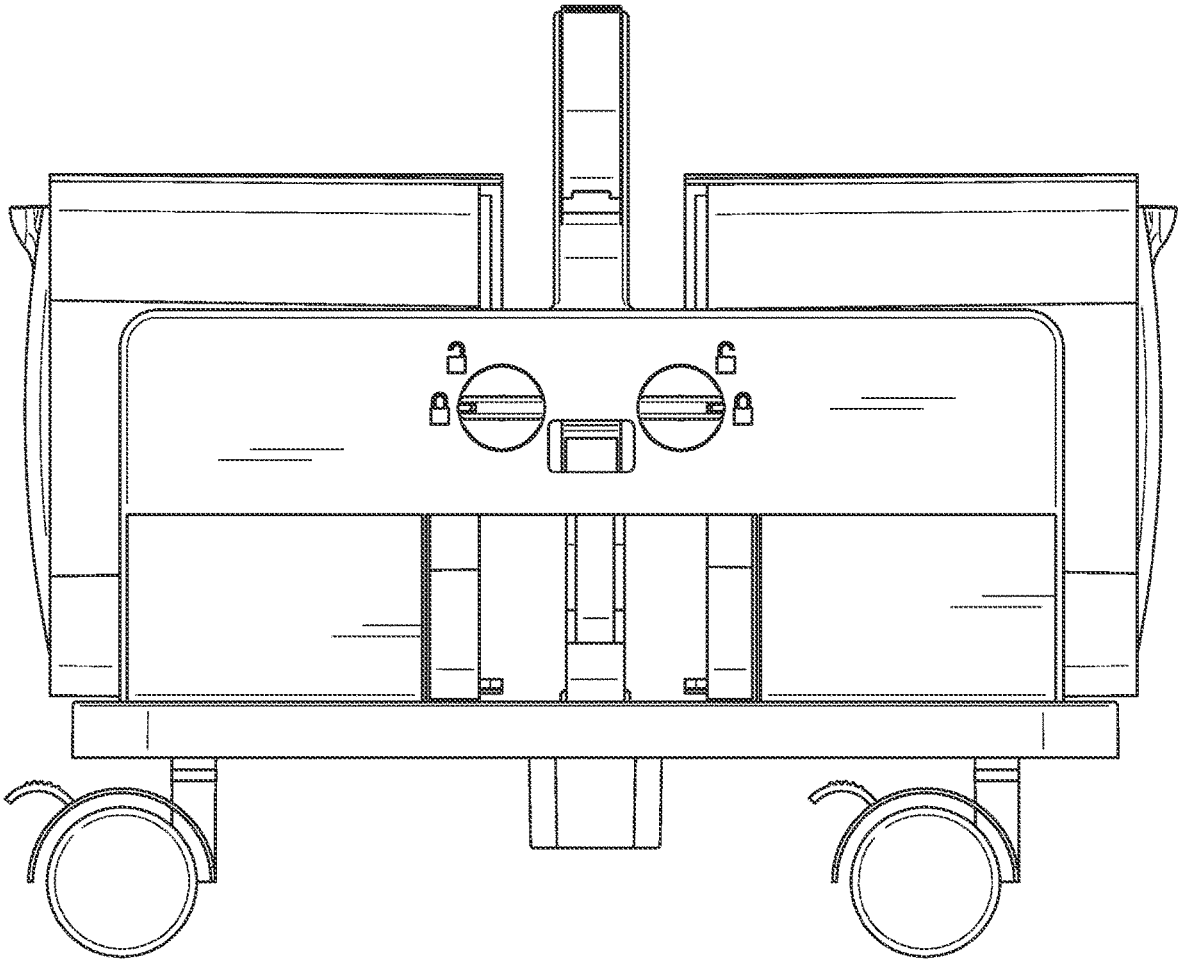
FIG. 32 is a left side view of the storage system of FIG. 30.
Figure 33:
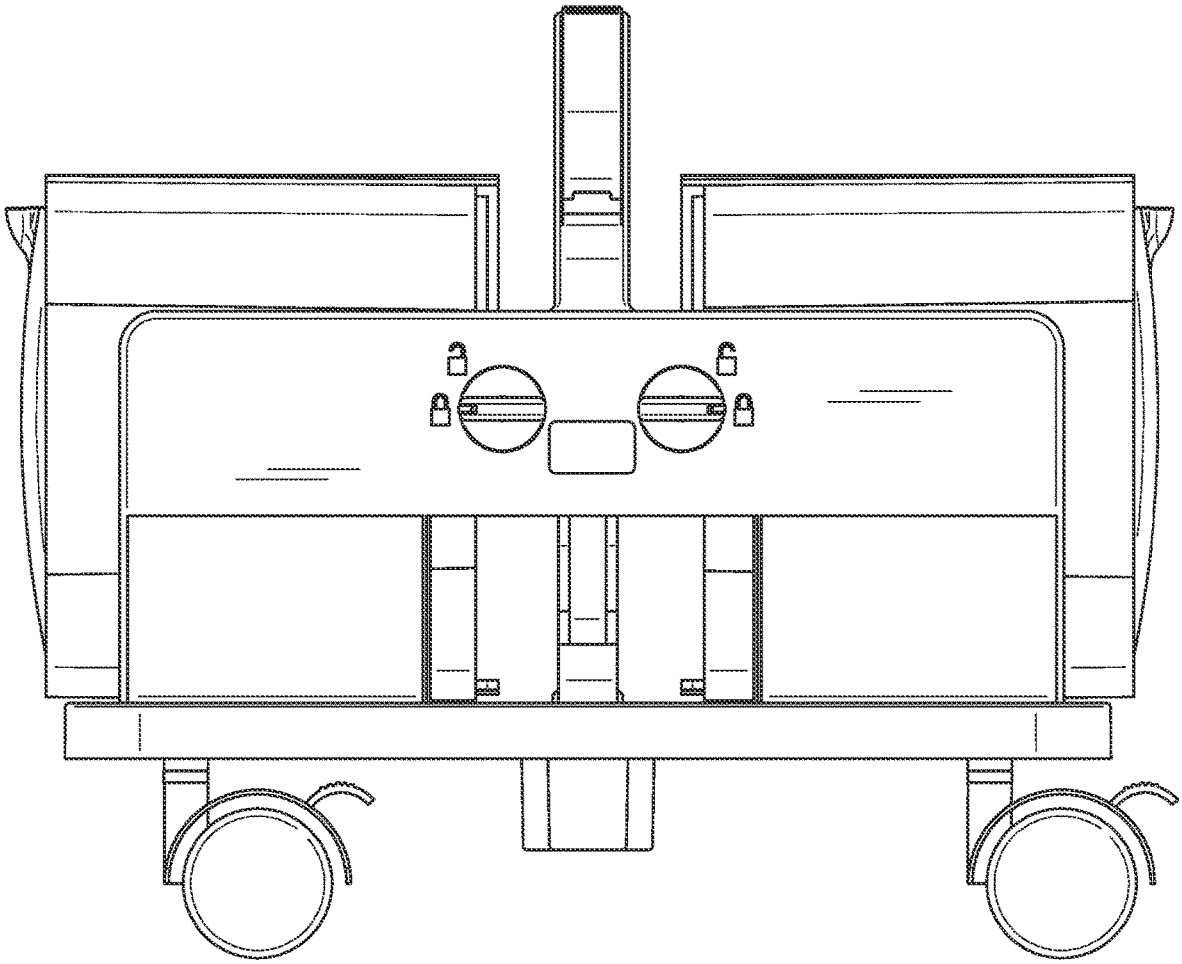
FIG. 33 is a right side view of the storage system of FIG. 30.
Figure 34:
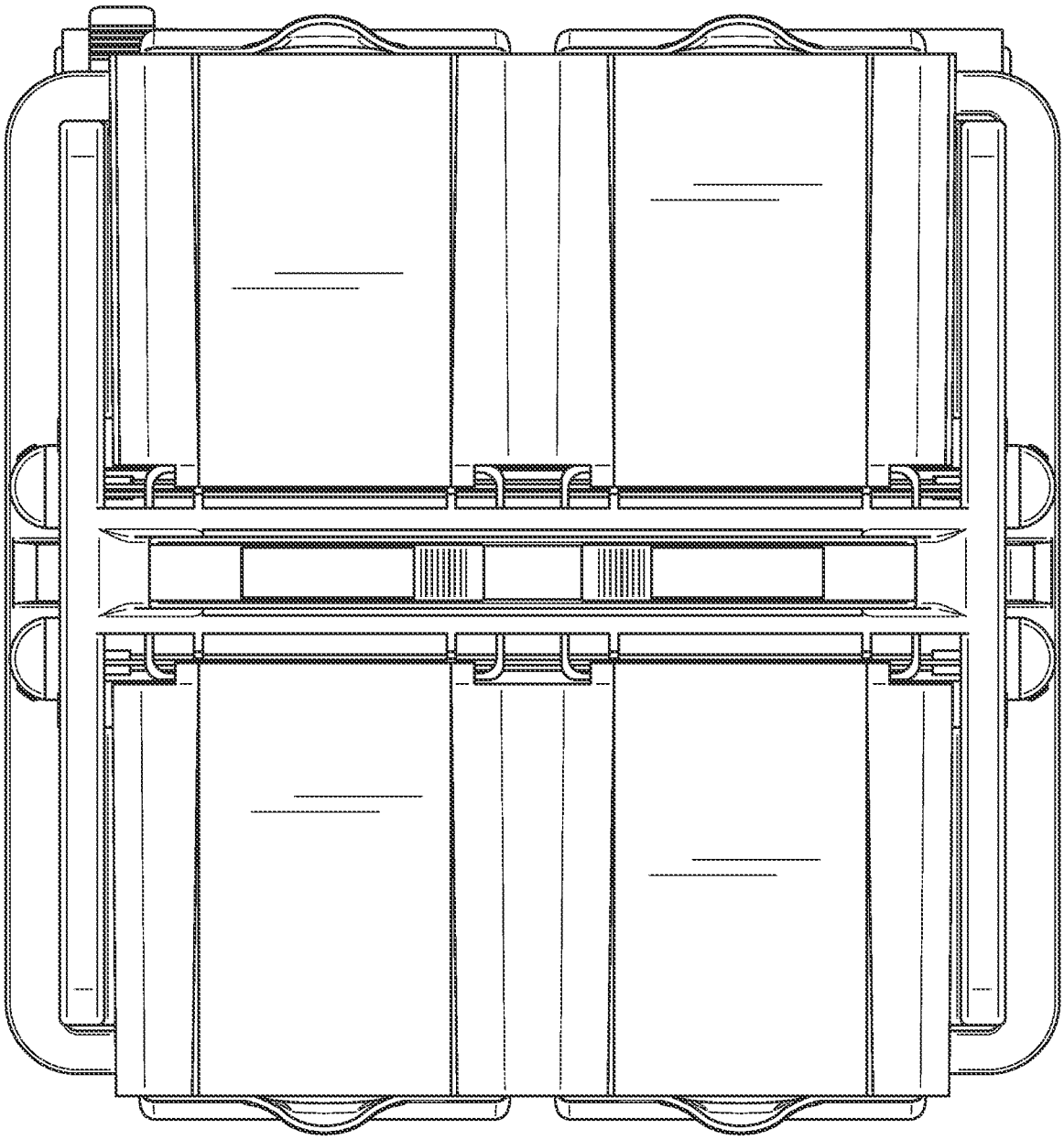
FIG. 34 is a top view of the storage system of FIG. 30.
Figure 35:
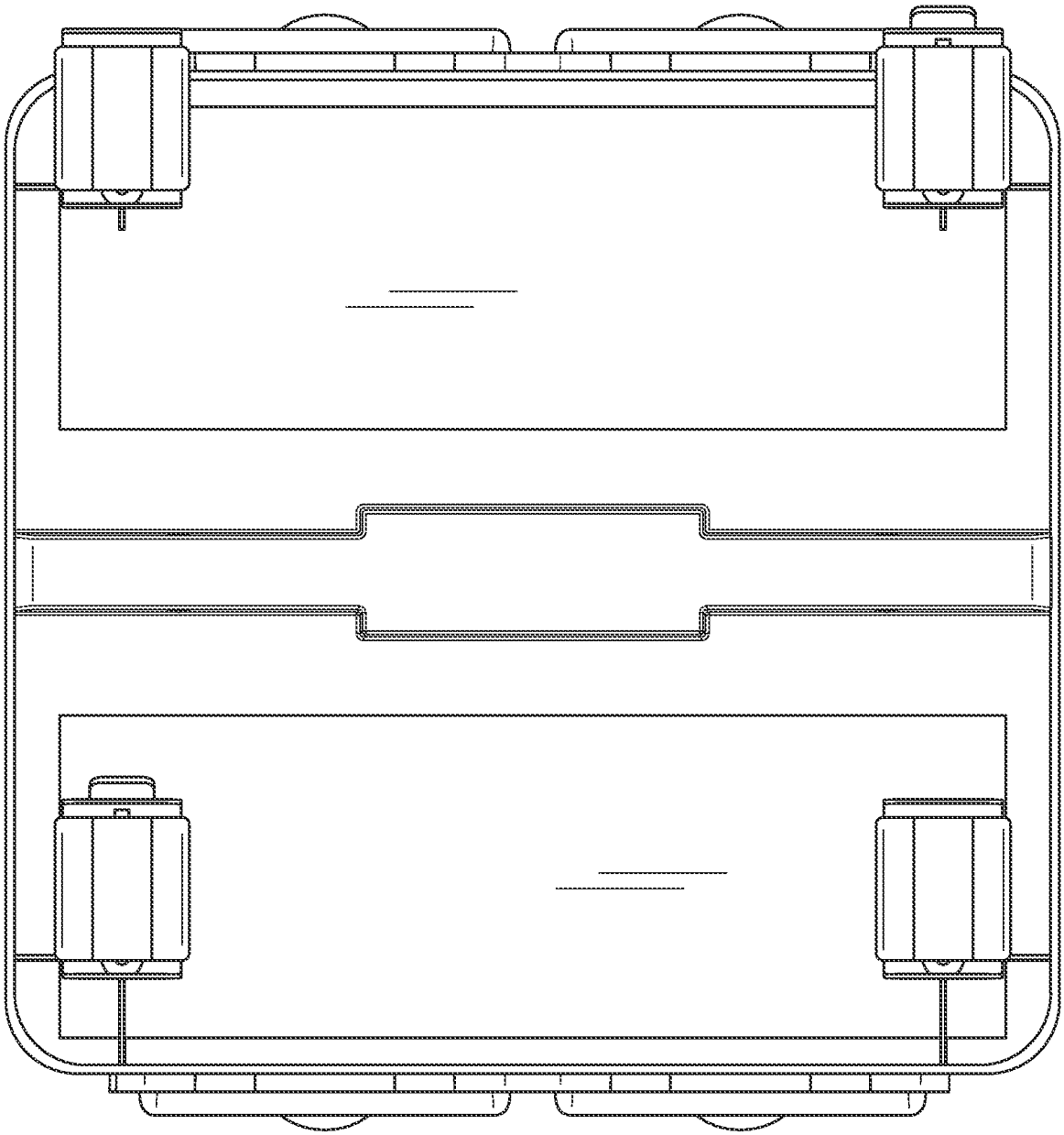
FIG. 35 is a bottom view of the storage system of FIG. 30.

The table top attachment 12, the storage-unit dock 18, and the storage unit 20A, 20B, may all be assembled together to form the storage system 10 as shown in FIG. 19. To fully assemble the customizable storage system 10, the first and second storage units are in the stacked mode, the table top attachment is in the table mode, and the storage-unit dock is in the transport mode like as shown in FIG. 19. Even fully assembled, the storage system 10 allows each of the storage containers 22A, 22B, 22C, 22D to be accessed.

The invention claimed is:

1. A customizable storage system comprising a storage unit, the storage unit comprising at least one removable storage container including a container shell and a tilt bin located in the container shell and formed to include an aperture arranged to open into a storage space formed in the tilt bin, and the tilt bin configured to tilt relative to the container shell between a retracted storage position in which the container shell blocks access to the storage space of the tilt bin through the aperture and an extended use position in which the tilt bin has tilted away from the container shell to allow access to the storage space through the aperture, a container caddy including a container support frame having a first container dock that defines a first container-receiving space configured to receive the at least one removable storage container, a second container dock spaced apart from the first container dock that defines a second container-receiving space configured to receive the at least one removable storage container, and a handle foundation that extends between and interconnects the first container dock and the second container dock and a carrying handle coupled to and extending away from the handle foundation of the container support frame, and at least one container rotary lock configured rotate between an unlocked position in which the tilt bin of the at least one removable storage container is free to change between the retracted storage position and the extended use position and a locked position in which the tilt bin is blocked from tilting relative to the container shell from the retracted storage position to the extended use position to prevent unwanted access to the storage space of the tilt bin through the aperture and the at least one removable storage container is blocked from moving relative to the container caddy from a stored position on the container caddy to prevent unwanted removal of the at least one removable storage container from one of the first container-receiving space formed in the first container dock and the second container-receiving space formed in the second container dock.

2. The customizable storage system of claim 1, wherein the at least one container rotary lock includes a lock rod having a first end coupled to a first side of the container support frame and a second end spaced apart axially from the first end of the lock rod along an axis and coupled to a second side of the container support frame, a lock knob coupled to one of the first end and the second end of the lock rod for rotation therewith, and a lock arm that extends radially from the lock rod relative to the axis, the lock arm configured to engage the tilt bin when the at least one container rotary lock is in the locked position.

3. The customizable storage system of claim 2, further comprising a container drop-in lock configured to retain the at least one removable storage container to the storage container support frame of the container caddy in the stored position on the container caddy to prevent the at least one removable storage container from moving out of the one of the first container-receiving space and the second container-receiving space of the container caddy when the tilt bin is moved from the retracted storage position to the extended use position so that the storage space of the tilt bin may be accessed while the at least one removable storage container is in the stored position.

4. The customizable storage system of claim 3, wherein the container drop-in lock includes a container connector tab coupled to the container shell of the at least one removable storage container and a container retainer strip coupled to the handle foundation of the container caddy, and wherein the container retainer strip defines a tab-receiving slot configured to receive the container connector tab when the at least one removable storage container is in the stored position to retain the at least one removable storage container to the storage container support frame of the container caddy.

5. The customizable storage system of claim 1, further comprising a container drop-in lock configured to retain the at least one removable storage container to the storage container support frame of the container caddy in the stored position on the container caddy to prevent the at least one removable storage container from moving out of the one of the first container-receiving space and the second container-receiving space of the container caddy when the tilt bin is moved from the retracted storage position to the extended use position so that the storage space of the tilt bin may be accessed while the at least one removable storage container is in the stored position.

6. The customizable storage system of claim 5, wherein the container drop-in lock includes a container connector tab coupled to the container shell of the at least one removable storage container and a container retainer strip coupled to the handle foundation of the container caddy.

7. The customizable storage system of claim 6, wherein the container retainer strip defines a tab-receiving slot configured to receive the container connector tab when the at least one removable storage container is in the stored position to retain the at least one removable storage container to the storage container support frame of the container caddy.

8. The customizable storage system of claim 1, wherein the storage unit further comprises a plurality of storage containers including a first pair of storage containers configured to be arranged in the first container-receiving space of the first container dock and a second pair of storage containers configured to be arranged in the second container-receiving space of the second container dock, a first container rotary lock configured to block tilting of the tilt bins included in the first pair of storage containers relative to the respective container shells from the retracted storage position to the extended use position and block movement of the first pair of storage containers relative to the container caddy when the first container rotary lock is in the locked position, and a second container rotary lock configured to block tilting of the tilt bins included in the second pair of storage containers relative to the respective container shells from the retracted storage position to the extended use position and to block movement of the second pair of storage containers relative to the container caddy when the second container rotary lock is in the locked position.

9. The customizable storage system of claim 8, wherein each of the first and second container rotary locks includes a lock rod having a first end coupled to a first side of the container support frame and a second end spaced apart axially from the first end of the lock rod along an axis and coupled to a second side of the container support frame, a lock knob coupled to one of the first end and the second end of the lock rod for rotation therewith, a first lock arm that extends radially from the lock rod relative to the axis.

10. The customizable storage system of claim 8, wherein the storage unit further comprises a container drop-in lock for each storage container included in the plurality of storage containers configured to retain the respective storage container to the storage container support frame of the container caddy in the stored position on the container caddy to prevent the at least one removable storage container from moving out of the respective container-receiving space of the container caddy when the tilt bin is moved from the retracted storage position to the extended use position so that the storage space of the tilt bin may be accessed while the respective storage container is in the stored position.

11. The customizable storage system of claim 10, wherein each container drop-in lock includes a container connector tab coupled to the container shell of the respective storage container and a container retainer strip coupled to one of a first side and a second side of the handle foundation of the container caddy, and wherein the container retainer strip defines a tab-receiving slot configured to receive the container connector tab when the respective storage container is in the stored position to retain the respective storage container to the storage container support frame of the container caddy.

12. The customizable storage system of claim 1, further comprising a table top attachment configured to be vertically stacked on top of the storage unit, the table top attachment including a table top panel and table support legs pivotally coupled to the table top panel to change between a retracted stowed position in which the table support legs confront the table top panel and an extended supporting position in which the table support legs extend perpendicular to the table top panel so as to engage the at least one removable storage container when the table top attachment is vertically stacked on top of the storage unit.

13. The customizable storage system of claim 12, wherein the carrying handle includes a main handle body coupled to and extending away from the handle foundation of the container support frame and attachment arms that are pivotally coupled the main handle body to pivot between a retracted handle position in which the attachment arms are received in a groove formed in the main handle body of the carrying handle so that the attachment arms are flush with upper edges of the main handle body and an extended attachment position in which the attachment arms extend upwardly from the main handle body of the carrying handle at a 90 degree angle relative to the main handle body of the carrying handle, and wherein each attachment arm is formed to include a projecting edge configured to mate with an opening formed in the table top panel of the table top attachment to secure the table top attachment with the storage unit in a table mode such that a topside of the table top panel provides a support surface.

14. A customizable storage unit comprising at least one storage container including a container shell and a tilt bin located in the container shell and formed to include an aperture arranged to open into a storage space formed in the tilt bin, and the tilt bin configured to tilt relative to the container shell between a retracted storage position in which the container shell blocks access to the storage space of the tilt bin through the aperture and an extended use position in which the tilt bin has tilted away from the container shell to allow access to the storage space through the aperture, a container caddy including a container support frame having a first container dock that defines a first container-receiving space configured to receive the at least one storage container, a second container dock spaced apart from the first container dock that defines a second container-receiving space configured to receive the at least one storage container, and a handle foundation that extends between and interconnects the first container dock and the second container dock and a carrying handle coupled to and extending away from the handle foundation of the container support frame, and at least one container rotary lock configured rotate between an unlocked position in which the tilt bin of the at least one storage container is free to change between the retracted storage position and the extended use position and a locked position in which the tilt bin is blocked from tilting relative to the container shell from the retracted storage position to the extended use position to prevent unwanted access to the storage space of the tilt bin through the aperture.

15. The customizable storage unit of claim 14, wherein the at least one container rotary lock includes a lock rod having a first end coupled to a first side of the container support frame and a second end spaced apart axially from the first end of the lock rod along an axis and coupled to a second side of the container support frame, a lock knob coupled to one of the first end and the second end of the lock rod for rotation therewith, and a lock arm that extends radially from the lock rod relative to the axis, the lock arm configured to engage the tilt bin when the at least one container lock is in the locked position.

16. The customizable storage unit of claim 14, further comprising a container drop-in lock configured to retain the at least one storage container to the storage container support frame of the container caddy in a stored position on the container caddy to prevent the at least one storage container from moving out of the one of the first container-receiving space and the second container-receiving space of the container caddy when the tilt bin is moved from the retracted storage position to the extended use position so that the storage space of the tilt bin may be accessed while the at least one storage container is in the stored position.

17. The customizable storage unit of claim 16, wherein the container drop-in lock includes a container connector tab coupled to the container shell of the at least one storage container and a container retainer strip coupled to the handle foundation of the container caddy, and wherein the container retainer strip defines a tab-receiving slot configured to receive the container connector tab when the at least one storage container is in the stored position to retain the at least one storage container to the storage container support frame of the container caddy.

18. The customizable storage unit of claim 14, further comprising a plurality of storage containers including a first pair of storage containers configured to be arranged in the first container-receiving space of the first container dock and a second pair of storage containers configured to be arranged in the second container-receiving space of the second container dock, a first container rotary lock configured to block tilting of the tilt bins included in the first pair of storage containers relative to the respective container shells from the retracted storage position to the extended use position when the first container rotary lock is in the locked position, and a second container rotary lock configured to block tilting of the tilt bins included in the second pair of storage containers relative to the respective container shells from the retracted storage position to the extended use position when the second container rotary lock is in the locked position.

19. The customizable storage unit of claim 18, wherein each of the first and second container rotary locks includes a lock rod having a first end coupled to a first side of the container support frame and a second end spaced apart axially from the first end of the lock rod along an axis and coupled to a second side of the container support frame, a lock knob coupled to one of the first end and the second end of the lock rod for rotation therewith, a first lock arm that extends radially from the lock rod relative to the axis.

20. The customizable storage unit of claim 18, further comprising a container drop-in lock for each storage container included in the plurality of storage containers configured to retain the respective storage container to the storage container support frame of the container caddy in a stored position on the container caddy to prevent the at least one storage container from moving out of the respective container-receiving space of the container caddy when the tilt bin is moved from the retracted storage position to the extended use position so that the storage space of the tilt bin may be accessed while the respective storage container is in the stored position, and wherein each container drop-in lock includes a container connector tab coupled to the container shell of the respective storage container and a container retainer strip coupled to one of a first side and a second side of the handle foundation of the container caddy to define a tab-receiving slot configured to receive the container connector tab when the respective storage container is in the stored position to retain the respective storage container to the storage container support frame of the container caddy.

* * * * *